United States Patent [19]

Matsuo et al.

[11] Patent Number: 4,912,518

[45] Date of Patent: Mar. 27, 1990

[54] AUTOMATIC DOCUMENT FEEDER FOR TWO-DOCUMENT ONE-SIDE COPYING

[75] Inventors: Hirokazu Matsuo; Hiroyasu Nagato, both of Osaka, Japan

[73] Assignee: Minolta Camera Kabushiki Kaisha, Osaka, Japan

[21] Appl. No.: 188,533

[22] Filed: Apr. 29, 1988

[30] Foreign Application Priority Data

May 1, 1987 [JP] Japan ..... 62-108624
May 1, 1987 [JP] Japan ..... 62-108625

[51] Int. Cl.[4] ..... G03G 21/00; B65H 7/02

[52] U.S. Cl. ..... 355/317; 271/227; 355/321

[58] Field of Search ..... 355/14 R, 3 SH, 14 SH, 355/23–25, 308, 317, 321; 271/226, 227, 228, 238, 256, 258, 259, 265

[56] References Cited

U.S. PATENT DOCUMENTS 3,288,459 11/1966 Hitchcock et al. .
4,052,054 10/1977 Cardwell et al. .
4,277,165 7/1981 Wada et al. .
4,575,227 3/1986 Ito et al. .
4,607,946 8/1986 Uchiyama et al. .
4,615,610 10/1986 Yoshiura .
4,634,263 1/1987 Miwa ..... 355/14 SH
4,657,375 4/1987 Watanabe et al. .
4,721,381 1/1988 Matsuo .
4,727,401 2/1988 Partilla et al. .
4,731,637 3/1988 Acquaviva et al. .
4,734,739 3/1988 Inuzuka et al. .
4,763,172 8/1988 Tsubota .
4,775,139 10/1988 Honjo et al. ..... 271/265 X
4,777,511 10/1988 Takahashi .
4,788,575 11/1988 Ito et al. .
4,814,825 3/1989 Johdai et al. ..... 355/14 SH X

FOREIGN PATENT DOCUMENTS 60-2942 1/1985 Japan .
60-93463 5/1985 Japan .
60-84945 6/1985 Japan .
62-47264 2/1987 Japan .

*Primary Examiner*—A. T. Grimley
*Assistant Examiner*—Ed Pipala
*Attorney, Agent, or Firm*—Burns, Doane, Swecker & Mathis

[57] ABSTRACT

An automatic document feeder provided on a copying machine, includes a document feeding unit, a transporting unit for transporting documents to a specified position on a platen and discharging the document therefrom, a pair of pinch rollers for registering the leading edge or trailing edge of the document, and a discharge roller for discharging the documents onto a tray. As the trailing edge of a first document has been registered by the pinch rollers, a second document is fed and the leading edge thereof is registered by the pinch rollers. The document in a pair serially aligned by the pinch rollers, are serially placed at the specified position on the platen. Further, the documents are discharged from the platen with a proper interval so that the leading edge of the second document does not push the trailing edge of the first document.

5 Claims, 21 Drawing Sheets

AUTOMATIC DOCUMENT FEEDER FOR TWO-DOCUMENT ONE-SIDE COPYING

BACKGROUND OF THE INVENTION

1. Field of the Invention

The present invention relates to an automatic document feeder provided on an image forming apparatus such as a copying machine.

2. Description of the Prior Art

To reduce a time for replacing original documents or to eliminate type procedure for the document replacement, various copying apparatuses provided with an automatic document feeder (hereinafter abbreviated as ADF) have been recently developed and commercially available. Such an ADF constitutes means for reducing indirect costs (time and labor). In contrast, to reduce direct costs (supplies, such as copy sheets and toner), several methods available are as follows: a duplex copying method, wherein two documents are copied to both sides of one copy sheet; and a method for reducing and copying two documents to one side of a copy sheet having the same size as each original document (two-document, single-face copying mode). In the former method, a pair of documents are unchangedly copied to one side of a copy sheet, while toner making for two copies is consumed. In copy sheet, while toner making for two copies is consumed. In contrast, the latter method is economical in that a copy sheet and toner each for only one sheet of document is consumed per two duplicates. Furthermore, when the above two methods combined, the result is extreme economization, since four documents are copied using both sides of one copy sheet.

Various conventional ADFs, however, feed documents one by one onto a platen. Accordingly, to perform two-document, one side copying, an operator is supposed to replace documents and place them on the platen per sheet of document, thus time and labor are not reduced.

To solve such disadvantages, improvements have been disclosed in the following patents, although all of them incur some problems. For example, an ADF for feeding two documents parallelly onto a platen has been disclosed in Japanese Patent Examined Publication No. 56-25657 (equivalent to U.S. Pat. No. 4,025,054). This type of ADF requires a time for parallelly setting documents on a document tray, and for rearranging the page order of documents after the documents are discharged. Additionally, this type of ADF also requires a space in the depth direction i.e. the direction perpendicular to the document feeding direction. As a result, the size of a copying apparatus is inevitably larger.

An ADF which is capable of serially placing two documents onto the platen by two transport belts disposed above the platen in tandem in the document feeding direction, has been disclosed in Japanese Patent Laid Open Publication Nos. 60-2942 and 60-84945. This type of ADF, however, also incurs a problem; the shadow between the two transport belts is unavoidably copied on a copy sheet when a thin document is copied.

Moreover, an ADF capable of serially setting two documents onto a platen has been disclosed in Japanese Patent Laid Open Publication No. 60-93462, wherein a second document separation device. This document feeding method is called the "serial double feeding". However, commercialization of a serial double feeding ADF is difficult due to its reliability, because accurate document feeding may not be achieved.

Additionally, the above-identified ADF which is capable of serially feeding two documents and placing them onto the platen in the document feeding direction involves a problem regarding document discharge from the platen. More specifically, since the two documents are placed without allowing an opening in between, the leading edge of the second document pushes the trailing edge of the first document, while two documents are discharged from the platen. Consequently, this may result in disturbance on the page order and alignment of documents discharged onto a discharge tray.

SUMMARY OF THE INVENTION

In view of the above-mentioned problems a main object of the present invention is to provide an ADF which is capable of accurately and continually feeding a pair of original documents onto a platen, and serially placing them at a specified position on the platen.

Another object of the present invention is to provide an ADF which is capable of placing a pair of documents, having been placed serially on a platen in the document feeding direction, to a discharge tray with good alignment and in exact order.

To realize the above objects an automatic document feeder according to the present invention, with means for sequentially feeding and registering document sheets to a exposure platen of the copier for their copying, including a pair of pinch rollers provided in the document sheet feeding path with forming a nipping portion therebetween for engaging an edge of the document sheet at the nipping portion so as to register the document sheet; the improvement wherein: said pinch rollers selectively rotate in the feeding direction or stop; said means for feeding and registering document sheets includes means for registering the first edges of the document sheets against the nipping portion of upstream side of the document feeding direction while said pinch rollers are kept on stopping; said means for feeding and registering document sheets further includes means for reversing the direction of motion of automatically preselected sequential document sheet to back the opposite edges of said preselected document sheets into registration with the nipping portion of downstream of the document feeding direction while said pinch rollers are kept on stopping; and said means for feeding and registering document sheets further includes means for feeding two said documents to the exposure platen together with one document sheet following the other, while said pinch rollers rotate in the document feeding direction.

Further, an automatic document feeder according to the present invention, for setting two original documents simultaneously on a platen of copying machine or the like, comprises: a tray for stacking original documents thereon; feed means for feeding the stacked documents one by one in a document feeding direction; transport means, including a transport belt which is rotatable in the document feeding direction and in the reverse to the document feeding direction, for positioning the document fed by said feed means on the platen; a pair of register rollers with forming a nipping portion therebetween disposed in a transport path formed between said feed means and said transport means, and capable of rotating in the document feeding direction to feed the document toward said transport means and of stopping the rotation thereof to register the leading edge or trailing edge of the document fed from said feed means; wherein processing with said automatic document feeder comprises a first step where a first document on said tray is transported by the rotation of said feed means, register rollers and transport belt to a position where the trailing edge of the first document has passed through said nipping portion; a second step where the first document is transported in the reverse direction by the reverse rotation of said transport belt while said register rollers are kept on stopping to register the trailing edge thereof against the nipping portion of downstream of the document feeding direction; a third step where a second document on said tray is transported by the rotation of said feed means while said register rollers are kept on stopping to register the leading edge thereof against the nipping portion of upstream of the document feeding direction; and a fourth step where first and second documents are simultaneously transported to the platen by the rotation of said transport belt and register rollers.

According to the above each constitution, the documents are stacked on the document tray in a document feeding means with the image surface facing down, and are subsequently fed one by one. After passing a pair of the register rollers disposed before the platen, the path for feeding a first document is transported with the transport belt, thereby the trailing edge of the first document is registered by the register rollers. At the same time, a second document is fed and the leading edge of the second document is similarly registered by the register rollers. By this arrangement, the two documents are serially and consecutively aligned by the register rollers, and the set documents are transported to the specific position on the platen with the transport belt.

According to the present invention described above, the two documents are accurately and serially placed at the specific position on the platen. Besides, a conventional ADF can be applied to the present invention, thus ensuring the practical applicability. Consequently, the ADF of the present invention offers the following advantages: When the ADF according to the present invention is used in conjunction with duplex copying function, four documents are copied using both sides of one copy sheet. Additionally, when the ADF of the present invention is used in conjunction with the page composition copying, wherein two pages of an open book are separately copied, the documents to be copied on both sides of one copy sheet are positively left on the platen until the completion of duplex copying. Accordingly, time and labor required for copying is substantially reduced, and document re-setting is not necessary even when copy sheet jamming occurs upon copying on the opposite side of copy sheet, thus allowing more flexible operation.

Additionally, to realize the above objects an automatic document feeder according to the present invention is capable of serially placing a pair of original document, fed from document feeding means, at a specified position on a platen in the document feeding direction, and discharging the documents from the platen after the completion of exposure, wherein said automatic document feeder comprises; a transport belt for transporting documents along the platen and a discharge roller for discharging documents, discharged from the platen, onto a discharge tray; wherein the transport velocity of the discharge roller is set greater than that of the transport belt.

Further, an automatic document feeder according to the present invention comprises said transport belt, said discharge roller, detect means for detecting whether a document has reached the discharge roller, and control means that interrupts the discharging operation with the transport belt when the detect means has detected the leading edge of a first document, and that re-starts the discharging operation when the detect means has detected the trailing edge of the first document.

Further, an automatic document feeder according to the present invention comprises said transport belt, said discharge roller, said detect means, and control means that interrupts the discharging operation with the transport belt when the detect means has detected the leading edge of a first document, and that re-starts the discharging operation when a predetermined duration has elapsed.

According to the present invention described above, two documents in a pair are discharged from the platen with a proper interval. Therefore, the leading edge of the second document does not push the trailing edge of the first document, effectively preventing the disturbance to alignment or order of the documents stacked on the discharge tray.

BRIEF DESCRIPTION OF THE DRAWINGS

These and other objects and features of the present invention will become apparent from the following description taken in conjunction with the preferred embodiments thereof with the reference of the accompanying drawings, in which:

FIG. 1 through FIG. 19 show a first embodiment of the present invention;

FIG. 1 is a schematic diagram showing the general constitution of a copying machine provided with an ADF;

FIG. 2 is a perspective view showing the constitution of the ADF;

FIG. 6 is a plan view showing a control panel;

FIG. 8 is a flow chart showing a main routine of a first CPU;

FIG. 9 is a flow chart showing a subroutine for the document feeding mode switch processing;

FIG. 10 is a flow chart showing a subroutine for the copy start processing;

FIG. 11 is a flow chart showing a main routine of a second CPU;

FIG. 12 is a flow chart showing a subroutine for the ADF start processing;

FIG. 13 is a flow chart showing a subroutine for the leading edge registering processing;

FIG. 14 is a flow chart showing a subroutine for the document size detection processing;

FIG. 15 is a flow chart showing a subroutine for the document feeding process (1);

FIG. 17 is a flow chart showing a subroutine for the document process (1);

FIG. 18 a flow chart showing a subroutine for the document dischrged process (2);

FIG. 19 is a flow chart showing a subroutine for another document discharge process (2)

DETAILED DESCRIPTION OF THE INVENTION

[First Embodiment]

The preferred this embodiment of an ADF according to the invention are hereunder described referring to the attached drawings. Such an ADF is mounted on an electro-photographic copying machine 1. First, the constitution of the copying machine 1 is hereunder described.

(Constitution and Operation of Copying Machine)

Figure 1:
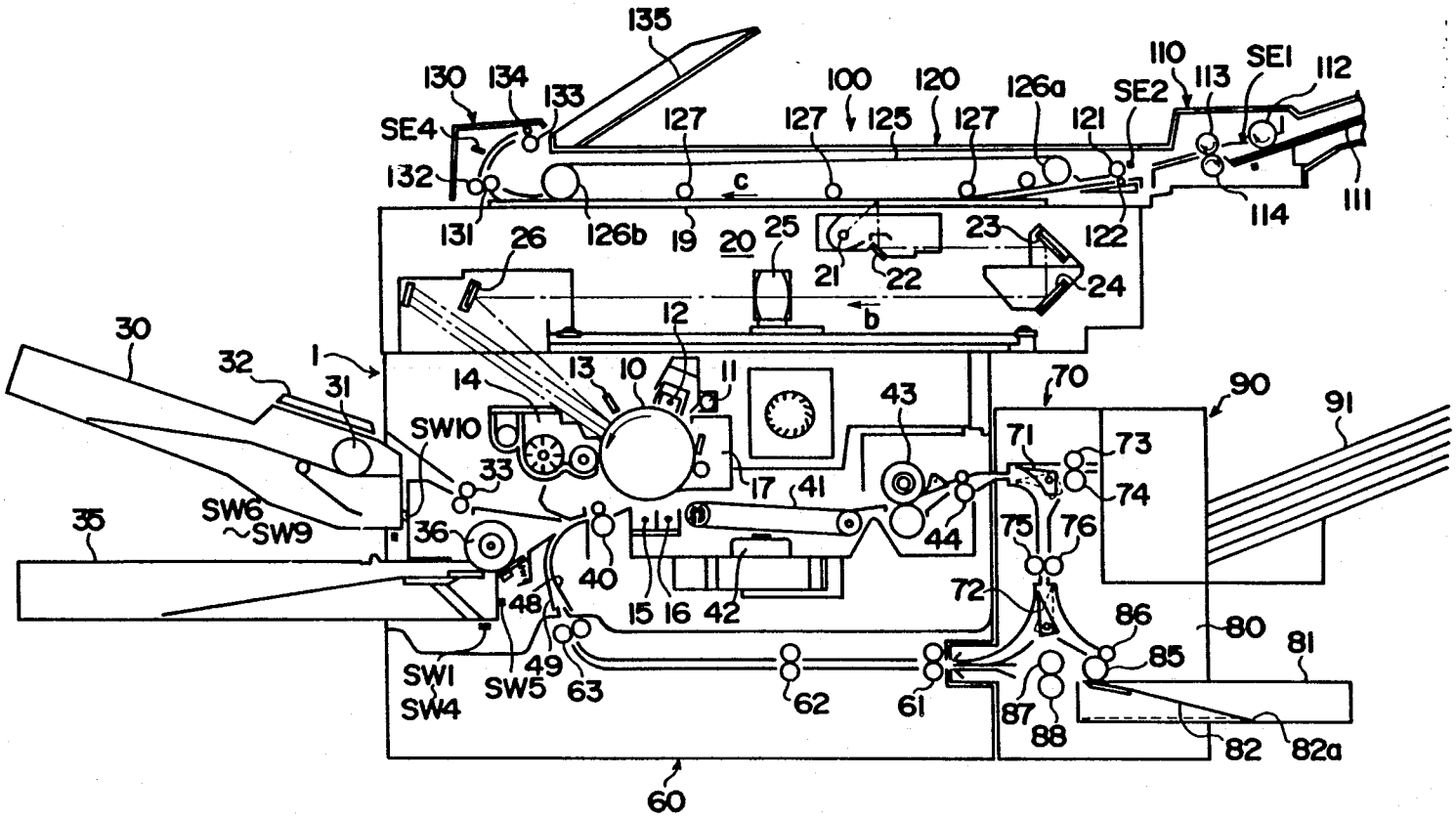

As illustrated in FIG. 1, the copying machine 1 is mounted on a re-fed sheet passing box 60, that is flanked by sheet feeding portions on the left, and by a duplex-composite copying unit 70, and a sorter 90 on the right.

In the approximate middle of the copying machine 1 is disposed a photosensitive drum 10 rotatable in the direction of an arrow a at a predetermined peripheral velocity V. Around the photosensitive drum 10 are sequentially disposed a main eraser 11, an electrifying charger 12, a suberaser 13, a magnetic brush-type developing unit 14, a transfer charger 15, a sheet separation charger 16 and a blade-type cleaning unit 17. During each copying operation, while rotating in the direction of the arrow a, the photosensitive drum 10, having a well-known photosensitive layer on the surface thereof, is neutralized and electrified by the main eraser 11 and the electrifying charger 12, has its unnecessary portions then neutralized by the suberaser 13, and is further subjected to imagewise exposing from an optical system 20 to form an electrostatic latent image. The electrostatic latent image becomes a toner image using the developing unit 14.

The optical system 20 capable of scanning an original image is disposed under a platen glass 19 and comprises an exposure lamp 21, a first mirror 22, a second mirror 23, a third mirror 24, an image-projecting lens 25, and a fourth mirror 26. The exposure lamp 21 and the first mirror 22 are integrally constituted and can move in the direction of an arrow b at a velocity of V/m (m: copying magnification) relative to the peripheral velocity V of the photosensitive drum 10 (constant regardless of whether the current magnification is an equal magnification or a modified magnification). The second mirror 23 and the fourth mirror 24 are integrally constituted and can move in the direction of the arrow b at a velocity of V/2m. In modifying a copying magnification, the lens 25 moves along the optical axis, accompanying the movement and oscillation of the fourth mirror 26 so as to correct the optical path.

On the other hand, copy sheets are stored in a stationary, automatic feeding cassette 30 and a detachable automatic feeding cassette 35, which are both disposed on the left side of the copying machine 1. The copy sheets are fed one by one by selectively rotating either of feeding rollers 31 or 36. Further, the top side of the cassette 30 is a manual feeding portion 32 from which copy sheets are fed one by one. A sheet fed from the cassette 30 or the manual feeding portion 32 is transported to a pair of timing rollers 40 through a transport roller 33; or a sheet fed from the cassette 35 is transported directly to the pair of timing rollers 40, where the sheet stops once. The sheet at the pair of timing rollers 40 is synchronized with the image formed on the surface of the photosensitive drum 10 and transported to a transfer portion to come in close contact with the photosensitive drum 10 where a toner image is transferred onto the sheet by means of the corona discharge of the transfer charger 15. Then, the sheet is separated from the photosensitive drum 10 by means of the AC corona discharge of the separation charger 16. Further, the sheet is drawn onto a transport belt 41, which is provided with an air suction unit 42, and transported to a fixing unit 43 where the toner image is fixed to the sheet; the sheet is then ejected through a pair of ejection rollers 44.

On the other hand, the post-transfer photosensitive drum 10 has residual toner and charge on the surface thereof removed by the cleaning unit 17 and the main eraser 11 in preparation for the next transfer process.

(Detection of Copy Sheet Size)

The above-mentioned sheet feeding portions are provided with microswitches SW1 through SW4, SW5, SW6 through SW9 and SW10. Microswitches SW1 through SW4 and SW6 through SW9 turn on or off based on the positions of a width regulating plate and the like for regulating the position of copy sheets, whereby based on the 4-bit configured codes respectively representing a combination of ON or OFF statuses of these microswitches, the size and feeding direction (longitudinal or latitudinal) of sheets stored in the cassettes 35 and 30 are detected. "longitudinal positioned" is defined that copy sheets have been set the longer side thereof in the sheet feeding direction. "latitudinal positioned" is defined that copy sheets have been set the shorter side thereof in the sheet feeding direction.

Copy sheet sizes applicable to this copying machinel, that is, sizes capable of being stored in the cassettes 30 and B5 are, for example, A3 size, A4 size, A5 size, A6 size, B4 size B5 size and B6 size; and for sheets of A4 size A5 size and 85 size, longitudinal or latitudinal positioned are available. Microswitches SW1 through SW4 also detect the attachment and detachment of the cassette 35. Table 1 shows one example of code table based on microswitches SW1 through SW4. In this table 1, "0" indicates that a microswitch is in "OFF" status; and "1" indicates that a microswitch is in "OFF" status. All the four microswitches in "OFF" status means that the cassette 35 has not been attached to the sheet feeding portion. The other group of microswitches SW6 through SW9 perform similar detection.

Microswitches SW5 and SW10 respectively disposed on the sheet feeding portions directly detect the presence and absence of sheets in the cassettes 35 and 30 respectively.

(TABLE 1)

| Binary Codes | | | | | Decimal |
|---|---|---|---|---|---|
| SW4 | SW3 | SW2 | SW1 | Sheet Size | Codes |
| 0 | 0 | 0 | 0 | | 0 |
| 0 | 0 | 0 | 1 | A6 Longitudinal Positioned | 1 |
| 0 | 0 | 1 | 0 | B6 Longitudinal Positioned | 2 |
| 0 | 0 | 1 | 1 | A5 Longitudinal Positioned | 3 |
| 0 | 1 | 0 | 0 | B5 Longitudinal | 4 |

(TABLE 1)-continued

| Binary Codes | | | | | Decimal |
|---|---|---|---|---|---|
| SW4 | SW3 | SW2 | SW1 | Sheet Size | Codes |
| | | | | Positioned | |
| 0 | 1 | 0 | 1 | A4 Longitudinal | 5 |
| | | | | Positioned | |
| 0 | 1 | 1 | 0 | B4 Longitudinal | 6 |
| | | | | Positioned | |
| 0 | 1 | 1 | 1 | A3 Longitudinal | 7 |
| | | | | Positioned | |
| 1 | 0 | 0 | 0 | A6 Latitudinal | 8 |
| | | | | Positioned | |
| 1 | 0 | 0 | 1 | B6 Latitudinal | 9 |
| | | | | Positioned | |
| 1 | 0 | 1 | 0 | A5 Latitudinal | 10 |
| | | | | Positioned | |
| 1 | 0 | 1 | 1 | B5 Latitudinal | 11 |
| | | | | Positioned | |
| 1 | 1 | 0 | 0 | A4 Latitudinal | 12 |
| | | | | Positioned | |
| 1 | 1 | 0 | 1 | B4 Latitudinal | 13 |
| | | | | Positioned | |
| 1 | 1 | 1 | 0 | A3 Latitudinal | 14 |
| | | | | Positioned | |
| 1 | 1 | 1 | 1 | Cassette Empty | 15 |

(Mechanism and Sheet Passing for Duplex and Composite Copying)

The duplex-composite copying unit 70 generally comprises a first switching tongue 71, a second switching tongue 72, ejection rollers 73 and 74, transport rollers 75 and 76, sheet guide plates correspondingly located around there, and a sheet re-feeding device 80. And the unit 70 is disposed a sorter 90 at the back thereof, including a plurality of bins 91.

The sheet re-feeding device 80 comprises a detachable re-feeding cassette 81; a pick up roller 85 used both receiving and re-feeding sheets; a collection roller 86 that is in contact with the pick up roller 85 and turns as a follower to the latter; a feeding roller 87; and a separation roller 88. The re-feeding cassette 81 is provided with a base plate 82 that is rockable on its rear end 82*a* and movable upward by an unshown elevating mechanism from a position shown with a dotted line to a position shown with a solid line.

The re-fed sheet passing box 60 comprises pairs of transport rollers 61, 62 and 63, and guide plates that surround the rollers to provide a transport path for copy sheets. A copy sheet re-fed from the unit 70 is transported by the pairs of rollers 61, 62, and 63 and through guide plates 48 and 49 in the copying machine 1 to the pair of timing rollers 40.

Sheet transport modes available in the unit 70 are a discharge mode, a duplex copying mode, and a composite copying mode. The sheet transport configuration relevant to each mode is set by the switching tongues 71 and 72. In the discharge mode, the tongue 71 is in a position shown by a dotted line as in FIG. 1, thereby a sheet is ejected to the sorter bin 91. In the duplex copying mode, the tongues 71 and 72 respectively take a position shown by a solid line, thereby a sheet with an image on one side is transported into the re-feeding cassette 81 as described previously. In the composite copying mode, the tongue 72 takes a position shown by a dotted line, thereby a sheet with an image on one side is immediately transported to the re-fed sheet passing box 60.

(Constitution and Operation of ADF)

The ADF 100 principally comprises a document feeding unit 110, a document transporting unit 120 and a document discharging unit 130, wherein the ADF 100 is capable of being opened up, as a whole, as supported on the rear portion thereof. The ADF 100, mounted on the platen glass 19 as illustrated in FIG. 1, can automatically feed documents to a specified position on the platen glass 19 as hereunder described. The feeding may be performed one by one; or pairs of documents may be automatically and serially transported to the specified position on the platen glass 19. Otherwise, an operator may lift the ADF 100 and place a document on the platen glass 19 in order to perform copying. Whether the ADF 100 is in the "up" position or "down" position is detected by a switch PSW (refer to FIG. 7*b*), thereby based on a detection signal generated, the ADF 100 and the copying machine 1 are synchronously controlled.

The document feeding unit 110 comprises a document tray 111, a pick up roller 112, a document separation roller 113 that rotates in the forward direction, a reverse roller 114, a feeding motor (not shown) for driving these rollers 112, 113 and 114, and a document detection sensor SE1. The document tray 111 is equipped with a sliding plate (not shown) that positions documents relative to document width direction. Documents are stacked on the document tray 111 with their faces down, and this state is detected by the sensor SE1. The vertically movable pick up roller 112 remains in an upper position while the ADF 100 is inactive. Once documents are stacked on the document tray 111, and the sensor SE1 turns on, and when an operator turns on a ADF switch SSW (refer to FIG. 7*b*), the pick up roller 112 comes down, presses the documents, and feeds the uppermost document by revolution.

The roller 113 rotates toward the direction of document feeding, while the roller 114 rotates in the reverse direction. As described previously, the separating rollers 113 and 114 are driven in conjunction with the pick up roller 112, only the uppermost document is fed into the document transporting unit 120 by the roller 113, and other documents are fed back into the document tray 111 by the reverse roller 114.

Figure 2:
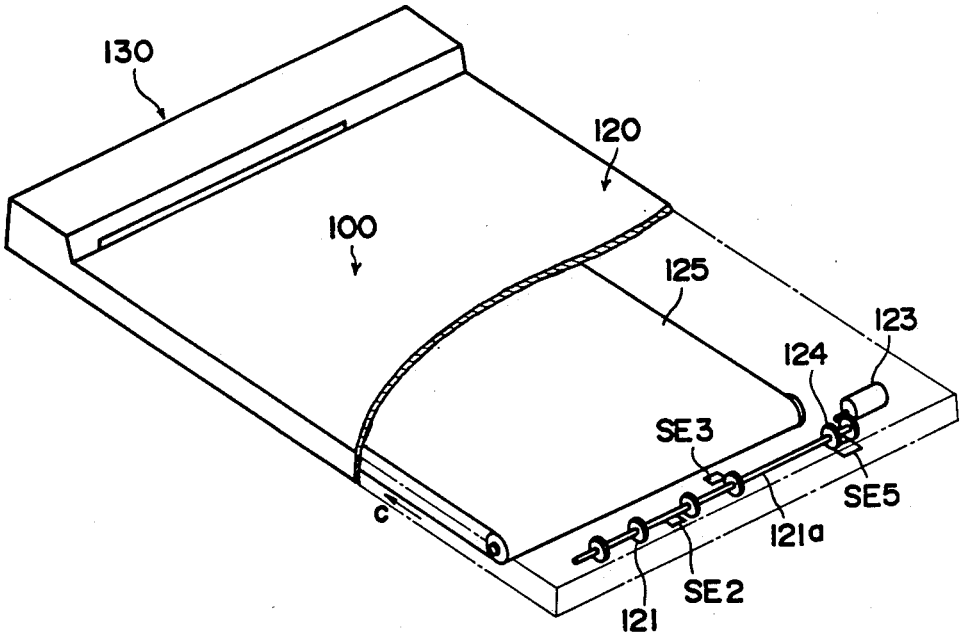

The document transporting unit 120 comprises pinch rollers 121 and 122, a motor 123 (refer to FIG. 2) for driving these pinch rollers, a transport belt 125, a motor (not shown) for driving the transport belt 124, and document detection sensors SE2 and SE3.

The transport belt 125 is an endless loop belt spanning between two support rollers 126*a* and 126*b* and pressed onto the platen glass 19 by presser rollers 127, whereby the transport belt 125 is capable of turning both in the forward direction indicated by an arrow c, and in the reverse direction.

When the sensor SE2 detects the leading edge of a document fed from the document feeding unit 110, the pick up roller 112, rollers 113, and 114 stop the rotations slightly after the detection. By this arrangement, the leading edge of this document comes into contact with the nip portion between the pinch rollers 121 and 122 and forms a loop in the upper stream side of the nip portion. This process corrects skew on the document.

The document is further transported onto the platen glass 19 by the rotation of the pinch rollers 121, 122, in conjunction with the forward travel of the transport belt 125 which transports the document in the direction of the arrow c. When the trailing edge of the document is detected by the sensor SE2, a timer is automatically started, thereby at the completion of the counting with the timer, the transport belt 125 temporarily stops. This arrangement enables the document to be set on a specified position on the platen glass 19.

Then, the ADF 100 outputs a copy start signal to the copying machine 1, thereby the copying machine 1 starts the copying operation. Once the previously mentioned optical system 20 completes the image exposure-scanning for predetermined number of copies, the copying machine 1 outputs a document replace signal to the ADF 100, thereby the transport belt 125 resumes transporting the document forward in the direction of the arrow c and discharges the document, from the platen glass 19.

In this process, the length of a document is measured by referring to signal pulses from a sensor SE5 that outputs the pulses based on the rotation of a disc 124 installed on an axle 121*a* of the pinch roller 121. More specifically, the output from the sensor SE5 is, in conjunction with the logical sum of the output from the sensor SE5 that detects a passing document and the output of the pinch roller 121, loaded into a second CPU 202 (refer to FIG. 7*b*), thereby the document span signal is generated by counting signal pulses generated while the documents passes the sensor SE2.

At the same time, the width of a document is detected and categorized by a sensor SE3. In this first embodiment, the sensor SE3 is disposed in a position where it is actuated (turns on) by an A4 or B5 document transported in a latitudinal orientation, and not actuated (off status) when an A4 or B5 document is transported in a longitudinal orientation. By this arrangement, the data not available based on the document span signal alone, that is, the size such as A4, A5, B4 and B6, and the orientation of a document being transported (latitudinal or longitudinal), are detected.

"Longitudinal orientation" is defined that a document is transported the longer side thereof in the document transporting direction, or a document is a size where the longer side thereof in parallel to the longer side of the platen glass 19. "Latitudinal orientation" is defined that a document is transported the shorter side thereof in the document transporting direction, or a document is a size where the shorter side thereof in parallel to the longer side of the platen glass 19.

The document discharging unit 130 comprises discharge rollers 131, 132, 133 and 134; guide plates correspondingly located around these rollers, a discharge tray 135, a motor for driving these rollers, and a document detection sensor SE4.

Once the previously mentioned optical system 20 has completed the image exposure-scanning for a pre-determined number of copies and the copying machine 1 outputs a document replace signal, the transport belt 125 resumes driving forward and the discharge rollers 131 through 134 resume rotating, thereby the document is transported from the platen glass 19 out onto the discharge tray 135. The document discharge movement stops a predetermined duration after the output of a trailing edge detection signal from the sensor SE4 i.e. the movement stops when the document is discharged onto the discharge tray 135.

When the sensor SE4 outputs the trailing edge detection signal and the sensor SE1 detects a document remaining on the document tray 111, the ADF 110 repeats the previously mentioned document feeding, setting and discharging procedures.

(Movement of Dual Feeding Mode for Document)

In this first embodiment, two selective modes are available with the ADF 100: an ordinary single feeding mode, wherein the ADF 100 sets a document one by one onto the specified position on the platen glass 19, and after image exposure-scanning, discharges the document therefrom; in a dual feeding mode, a pair of documents are sequentially fed onto the platen glass 19 and set serially, and discharged after simultaneous image exposure-scanning.

(1) Document feeding movement

The document feeding operation in the dual feeding mode is hereunder described referring to FIG. 3*a* through FIG. 3*i*.

Once the dual feeding mode is selected and the ADF start switch SSW turns on, documents on the document tray 111 are fed starting from the uppermost document. A couple of documents are separated by the separation rollers 113 and 114 as mentioned previously, and fed out of the feeding unit 110 (refer to FIG. 3*a*).

Figure 3A:
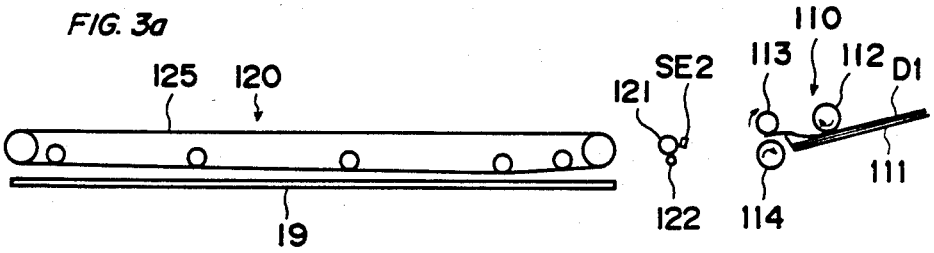
FIG. 3*a* through FIG. 3*i* are explanatory drawings showing the document feeding operation.
Figure 3B:
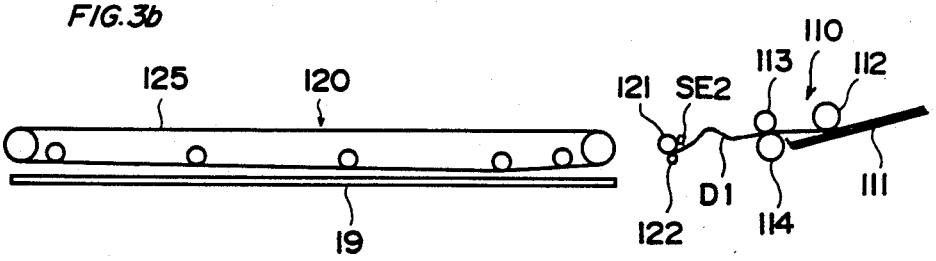

When the leading edge of a first document D1 touches the nipping portion between the pinch rollers 121 and 122, the document D1 forms a loop in the upstream side of the nipping portion (refer to FIG. 3*b*). This treatment is hereinafter called the leading edge registering.

Figure 3C:
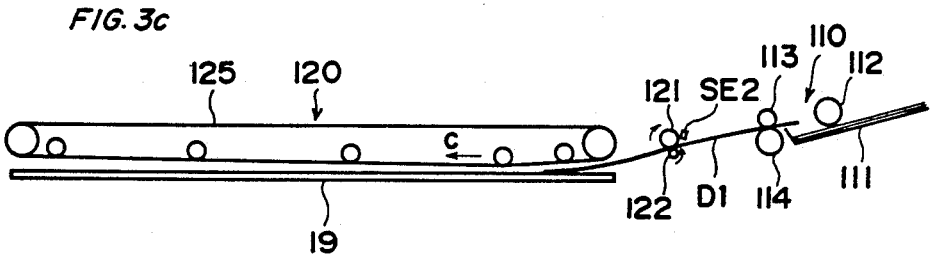

The first document D1 is then transported toward the platen glass 19 by the rotation of the pinch rollers 121 and 122 as well as by the forward movement of the transport belt 125 in the direction of the arrow c (refer to FIG. 3*c*).

Figure 3D:
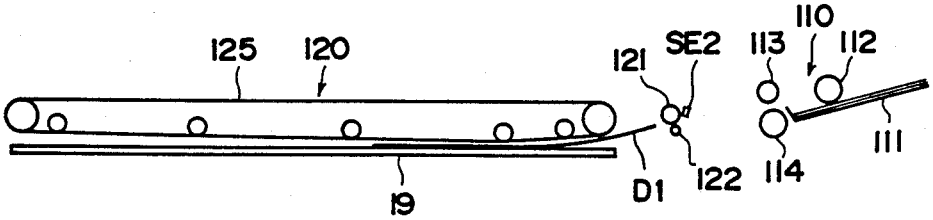
Figure 3E:
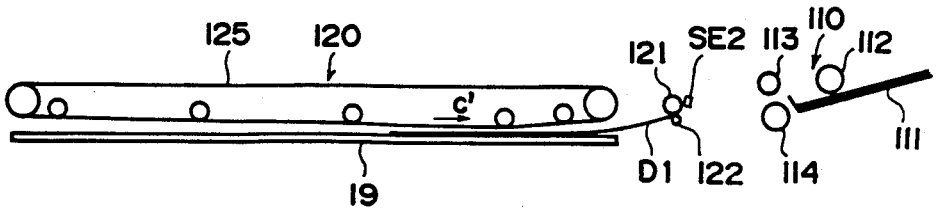
Figure 3F:
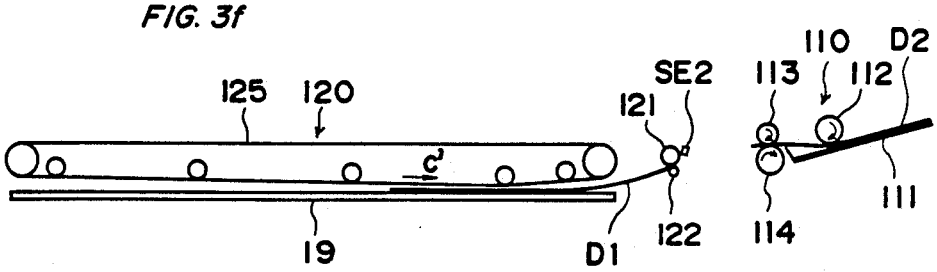

When the trailing edge of the first document D1 passes through the pinch rollers 121 and 122, the rotation of the pinch rollers 121, 122 and the transport belt 125 temporarily stop (refer to FIG. 3*d*). Then, the transport belt 125 moves reverse until the trailing edge of the first document D1 touches the nipping portion between the pinch rollers 121 and 22 (refer to FIG. 3*e*). This treatment is hereinafter called the trailing edge registering.

Figure 3G:
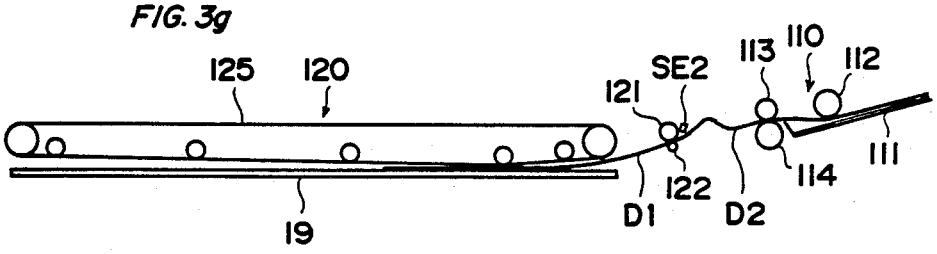

While the first document D1 is in a status where the trailing edge thereof being registered, a second document D2 is fed (refer to FIG. 3*f*) and treated for the leading edge registering (refer to FIG. 3*g*). As a result, a pair of the documents D1 and D2 are serial-sequentially set with one registered its trailing edge and the other registered its leading edge by the pinch rollers 121 and 122.

Figure 3H:
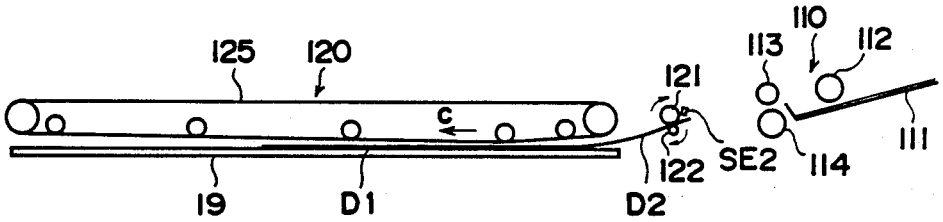
Figure 3I:
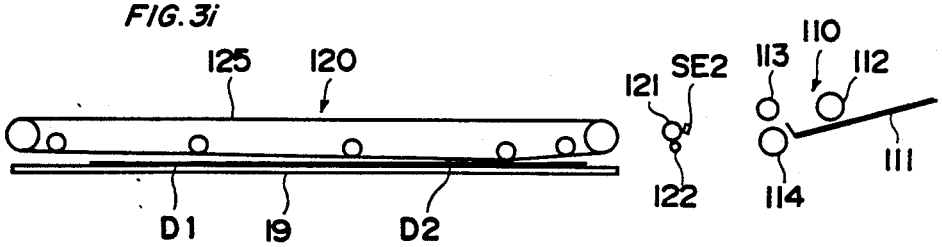

The pair of documents D1 and D2 thus set serial-sequentially are transported simultaneously onto the platen glass 19 by the forward rotation of the pinch rollers 121, 122 and the transport belt 125 (refer to FIG. 3*h*). When the trailing edge of the second document D2 is set to the specified position on the platen glass 19 i.e. the starting position of exposure by the optical system 20, the pinch rollers 121, 122 and the transport belt 125 stop (refer to FIG. 3*i*). The pair of documents D1 and D2 are thus set serial-sequentially at the specified position of the platen glass 19.

(2) Document discharge movement

In the dual feeding mode, wherein a pair of documents are serial-sequentially set without an opening between them, the leading edge of the second document pushes the trailing edge of the first document when discharged, possibly resulting in mis-alignment or page disorder on the discharge tray 135.

Therefore, in the dual feeding mode, an arrangement is made so that a pair of documents are discharged onto the discharge tray 135 with an interval in order to ensure document alignment on the discharge tray 135. Such document discharge movement is available in the following three methods.

In the first method, when the first document reaches the discharge rollers 131 and 132, the transport belt 125 temporarily stops so as to have the second document remain on the platen glass 19 until the proper interval forms between the documents. The transport belt 125 resumes driving forward after this step.

More specifically, upon reception of the document replace signal, the transport belt 125 moves forward and the discharge rollers 131 through 134 drive (refer to FIG. 4*a*), thereby the documents D1 and D2 start discharge movement in the direction of the arrow c. When the leading edge of the first document D1 is detected by the sensor SE4, the transport belt 125 stops temporarily (refer to FIG. 4*b*). The first document D1 is further transported by the discharge rollers 131 through 134, while the second document D2 remains on the platen glass 19 so that an appropriate interval forms between the pair of documents D1 and D2 (refer to FIGS. 4*c* and 4*d*).

When the sensor SE4 detects the trailing edge of the first document D1, the transport belt 125 resumes forward movement so as to carry the second document D2 (refer to FIG. 4*e*), and the pair of documents D1 and D2 are discharged onto the discharge tray 135 with an appropriate interval between them.

In the second method, the document transport speed of the discharge rollers 131 through 134 is set somewhat larger than that of the transport belt 125 so that an appropriate interval is incorporated between two documents.

Figure 5A:
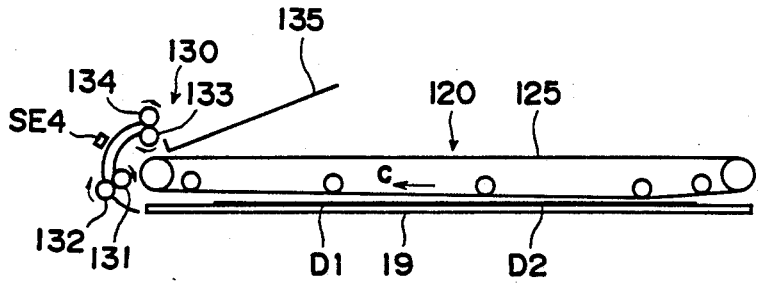
FIG. 5*a* through FIG. 5*c* are explanatory drawings showing another document discharging operation.

More specifically, upon reception of the document replace signal, the transport belt 125 moves forward, and the discharge rollers 131 through 134 rotate, whereby the document transport speed of the discharge rollers 131 through 34 are set somewhat larger than that of the transport belt 25 (refer to FIG. 5*a*). Due to this difference in speeds, the gradually increasing interval is incorporated between the pair of documents D1 and D2 (refer to FIGS. 5*b* and 5*c*), and, accordingly, the pair of documents D1 and D2 are discharged onto the discharge tray 135 with an appropriate interval.

In the third method, the document discharge operation is controlled by the following arrangement. The discharge operation with the transport belt 125 is interrupted once the sensor SE4 detected the trailing edge of the first document, thereby the first document is discharged onto the document tray 135 by the discharge rollers 131 through 134. Then, the second document is left stationarily on the platen glass 19. Subsequently, the second document is discharged after a predetermined duration by re-starting the discharge operation of the transport belt 125.

Concerning the setting of the speeds described above, the speed of the discharge rollers 131 and 132 in the upstream side may be equal to that of the transport belt 125. In this case, however, the speed of the discharge rollers 133 and 134 is set larger than that of the discharge rollers 131 and 132, which are designed to serve as followers to the rotations of the discharge rollers 133 and 134 while a document is transported by the discharge rollers 133 and 134.

(Single Feeding in Dual Feeding Mode)

In the above-mentioned dual feeding mode, if the number of documents is an odd number, a single document remains for the last copying cycle as the result of feeding documents pair by pair. Accordingly, in the last cycle, the sensor SE1 outputs a document empty signal when the last document is fed, thereby the final document is subjected to the processing under the single feeding mode.

(Automatic Magnification Setting Function (AMS))

The copying machine 1 is provided with the automatic magnification setting function (hereinafter referred to as AMS), thereby the relevant magnification for copying is automatically designated so as not to produce an image with a part missing, when an operator specifies a copy sheet size and a original document size.

Once the AMS mode is selected, the second CPU 202 judges a document size, which is then encoded and transmitted to the first CPU 201. The first CPU 201 arithmetically determines the relevant magnification based on the document size code, and on the size code of copy sheets stored in the cassette 30 or 35 that is selected by an operator, thereby if the determined magnification is within the specified scope for the copying machine 1, this magnification is enabled; if the determined magnification is not within the specified scope, the first CPU 201 warns the operator that the relevant magnification cannot be automatically designated and that manual setting is required.

Table 2 below exhibits the correlation between the relevant magnifications calculated from the sheet size and the document size in the AMS mode in conjunction with the ordinary single feeding mode (one-by-one document feeding).

(TABLE 2)

| | | | Single Feeding Mode, By AMS | | | | | | | | | |
|---|---|---|---|---|---|---|---|---|---|---|---|---|
| | | | Sheet Size selected by Operator | | | | | | | | | |
| | | | A6 | B6 | A5R Lo. P. | A5 La. P. | B5R Lo. P. | B5 La. P. | A4R Lo. P. | A4 La. P. | B4 | A3 |
| Document Size | A5 | Longitudinal Orientation | 0.707 | 0.866 | 1.000 | 0.707 | 1.225 | 0.866 | 1.414 | 1.000 | 1.420 | 1.420 |
| | A5 | Latitudinal Orientation | M | M | 0.707 | 1.000 | 0.866 | 1.225 | 1.000 | 1.414 | 1.225 | 1.414 |
| | B5 | Longitudinal Orientation | M | 0.707 | 0.816 | M | 1.000 | 0.707 | 1.154 | 0.816 | 1.414 | 1.420 |
| | B5 | Latitudinal Orientation | M | M | M | 0.816 | 0.707 | 1.000 | 0.816 | 1.154 | 1.000 | 1.154 |
| | A4 | Longitudinal Orientation | M | M | 0.707 | M | 0.866 | M | 1.000 | 0.707 | 1.225 | 1.414 |
| | A4 | Latitudinal Orientation | M | M | M | 0.707 | M | 0.866 | 0.707 | 1.000 | 0.866 | 1.000 |

(TABLE 2)-continued

| | Single Feeding Mode, By AMS | | | | | | | | | |
|---|---|---|---|---|---|---|---|---|---|---|
| | Sheet Size selected by Operator | | | | | | | | | |
| | A6 | B6 | A5R Lo. P. | A5 La. P. | B5R Lo. P. | B5 La. P. | A4R Lo. P. | A4 La. P. | B4 | A3 |
| B4 | M | M | M | M | 0.707 | M | 0.816 | M | 1.000 | 1.154 |
| A3 | M | M | M | M | M | M | 0.707 | M | 0.866 | 1.000 |

Effective Magnification on Machine Ranges 0.640–1.430
(M shows manual mode)
(Lo. P. shows longitudinal positioned)
(La. P. shows latitudinal positioned)

(Automatic Paper Size Setting Function (APS))

The copying machine 1 is provided with the automatic paper size setting function (hereinafter referred to as APS), whereby when an operator specifies a document size and a magnification, a cassette storing a relevant size of sheets is automatically designated so as not to form an image of its part missing.

Once the APS mode is selected, the second CPU 202 judges a document size, which is then encoded and transferred to the first CPU 201. The first CPU 201 arithmetically determines the relevant sheet size based on the entered document size code, and on the magnification selected by an operator, and then, selects either cassette 30 or 35, in which sheets of the determined magnification are stored. If sheets of a relevant size are not stored in either cassette 30 or 35, nor a relevant size is within the specified scope of the copying machine 1, the first CPU 201 warns the operator that the sheets of a relevant are not available, and that either the manual setting of a sheet feeding cassette or the manual resetting of magnification is required.

Table 3 below exhibits the correlation among the document sizes, magnifications, and the relevant sheet sizes calculated from the document sizes and magnifications in the APS mode in conjunction with the ordinary single feeding mode in which documents are fed one by one.

(TABLE 3)

| | | | Single Feeding Mode, By APS | | | | | | |
|---|---|---|---|---|---|---|---|---|---|
| | | | Magnification selected by Operator | | | | | | |
| | | | 0.640–0.711 | 0.712–0.823 | 0.824–0.871 | 0.872–1.007 | 1.008–1.159 | 1.160–1.231 | 1.232–1.420 |
| Document Size | A5 | Longitudinal Orientation | A6 Lo. P. | B6 Lo. P | B6 Lo. P | A5 Lo. P | B5 Lo. P. | B5 Lo. P. | A4 Lo. P. |
| | A5 | Latitudinal Orientation | A5 La. P. | A5 La. P. | A5 La. P. | A5 La. P. | B5 La. P. | B5 La. P. | A4 La. P. |
| | B5 | Longitudinal Orientation | B6 Lo. P. | A5 Lo. P. | B5 Lo. P. | B5 Lo. P. | A4 Lo. P. | B4 Lo. P. | B4 Lo. P. |
| | B5 | Latitudinal Orientation | A5 La. P. | A5 La. P. | B5 La. P. | B5 La. P. | A4 La. P. | M | M |
| | A4 | Longitudinal Orientation | A5 Lo. P. | B5 Lo. P. | B5 Lo. P. | A4 Lo. P. | B4 Lo. P. | B4 Lo. P. | A3 Lo. P. |
| | A4 | Latitudinal Orientation | A5 La. P. | B5 La. P. | B5 La. P. | A4 La. P. | M | M | M |
| | B4 | Longitudinal Orientation | B5 Lo. P. | A4 Lo. P. | B4 Lo. P. | B4 Lo. P. | A3 Lo. P. | M | M |
| | A3 | Longitudinal Orientation | A4 Lo. P. | B4 Lo. P. | B4 Lo. P. | A3 Lo. P. | M | M | M |

Effective Magnification on Machine Ranges 0.640–1.420
(M shows manual mode)
(Lo. P. shows longitudinal positioned)
(La. P. shows latitudinal positioned)

(Correlation among Document Size, Magnification and Copy Sheet Size under Dual Feeding Mode)

When the ADF 100 is actuated in the dual feeding mode to copy images of a pair of documents to one side of a copy sheet, the correlation among a document size, magnification and a copy sheet size is as described hereunder. If two A4 size documents are positioned latitudinally and a magnification is set to [1.000], A3 size sheet is selected so that images on a pair of documents are copied adequately to one sheet. Additionally, if a designated magnification is [0.707], a longitudinally positioned A4 size sheet is selected Similarly, if a pair of two A4 size documents are positioned latitudinally and A3 size sheet is specified, a magnification is set to 1.000] and if a longitudinally positioned A4 size sheet is selected, a magnification is set to [0.707].

As described above, the execution of the dual feeding mode by the ADF 100 enables the transfer of images on a pair of documents onto one sheet, resulting in economization in terms of both sheet and copy time. In addition, the dual feeding mode, when used together with the duplex copying mode, enables the transfer of images on four documents onto one sheet. Further, the copying machine 1 may be provided with a page divisional copying function where two pages on a book are individually subjected to exposure scanning. Accordingly, the combined use of the dual feeding mode, the page divisional copying mode, and the duplex copying mode, can copy a pair of documents to the respective sides of one sheet. Such copying modes enable further economization in terms of both sheet and copy time.

(Operation Panel)

Figure 6:
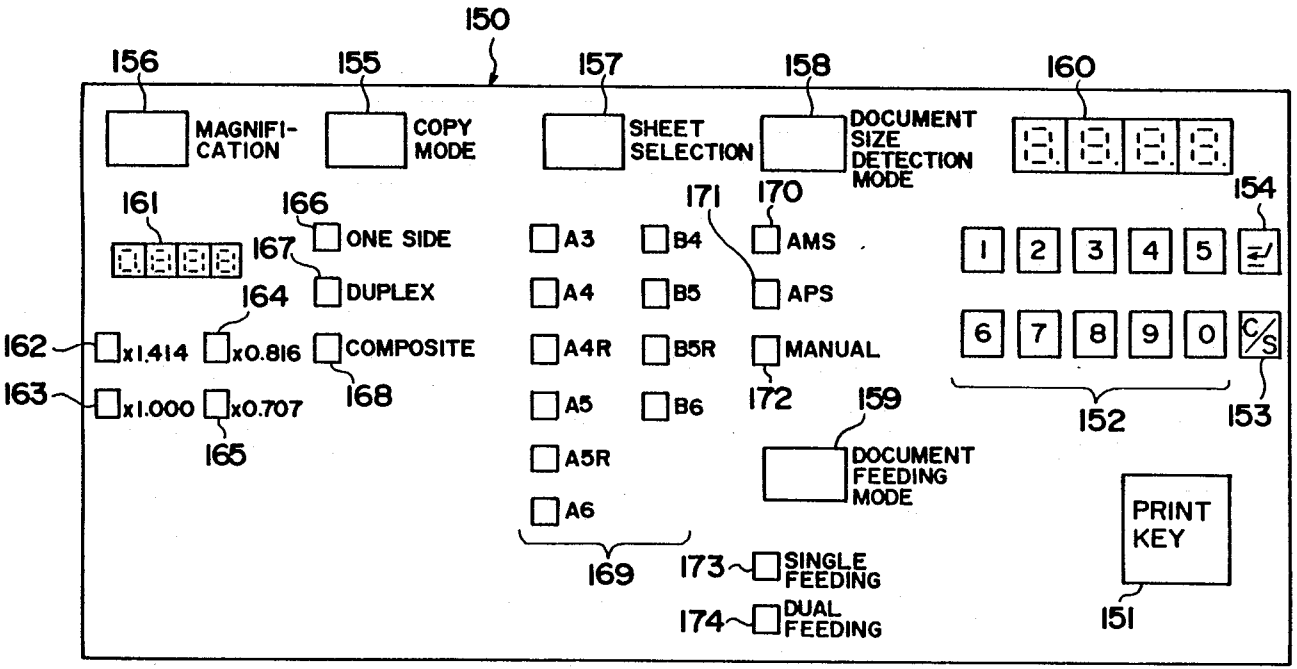

As illustrated in FIG. 6, an operation panel 150 on the main body of the copying machine 1 is provided with keys and indicators hereunder described; each key internally has a switch that is turned on when pressed.

Numeral 151 represents a print key for starting a copying operation; 152, a ten key portion for entering numerical data such as a number of copies; 153, a clear/-stop key 153 for terminating multi-copying and for clearing entered numerical data; 154, an interruption key 154 for executing an interruption copy; 155, a selector key for selecting a mode being executed from the ordinary one side copying mode, the duplex copying mode, and the composite copying mode; 156, a magnification selector key for selecting a preset magnification or for designating an arbitrary magnification; 157, a copy sheet selection key for selecting a sheet size; 158, a document size detection mode selector key for selecting any of the previously mentioned AMS, APS, and manual modes; 159, a document feeding mode selector key for selecting a document feeding mode between a single feeding mode and a dual feeding mode.

The operation panel 150 is also provided with indicating means hereunder described.

Numeral 160 represents a 4-position display segment 160 for indicating, for example, a number of copies; 161, a 4-position display segment for indicating a manually designated magnification; 162 through 165, LEDs for indicating a preset copy magnification; 166, an LED for indicating the ordinary one side copying mode; 167, an LED for indicating the duplex copying mode; 168, an LED for indicating the composite copying mode; 169, LEDs for indicating a copy sheet size; 170, an LED for indicating the AMS mode; 171, an LED for indicating the APS mode; 172, an LED for indicating the manual mode; 173 for indicating the single feeding mode; 174, an LED for indicating the dual feeding mode. The indication of the LEDs described above increments or decrements step by step every time being pressed.

(Control Circuit)

Figure 7A:
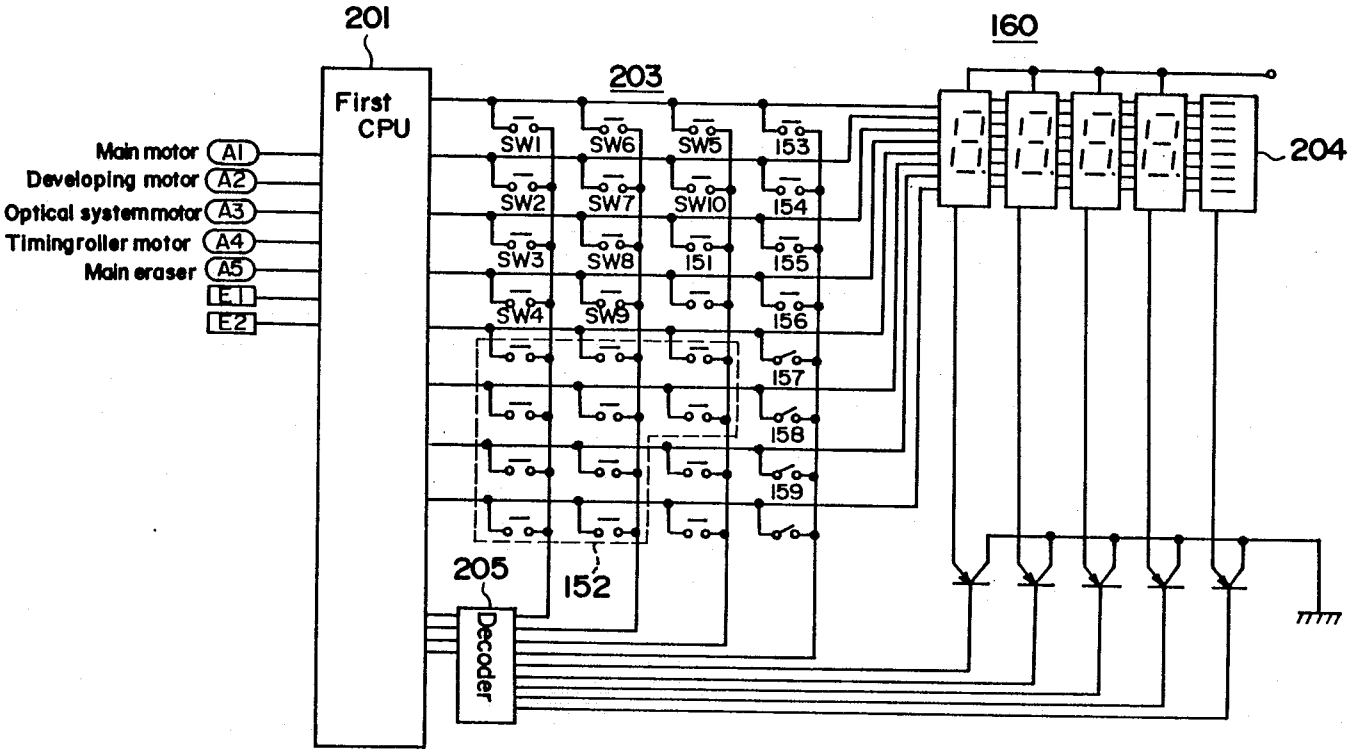
FIGS. 7*a* and 7*b* are diagram showing a control circuit.
Figure 7B:
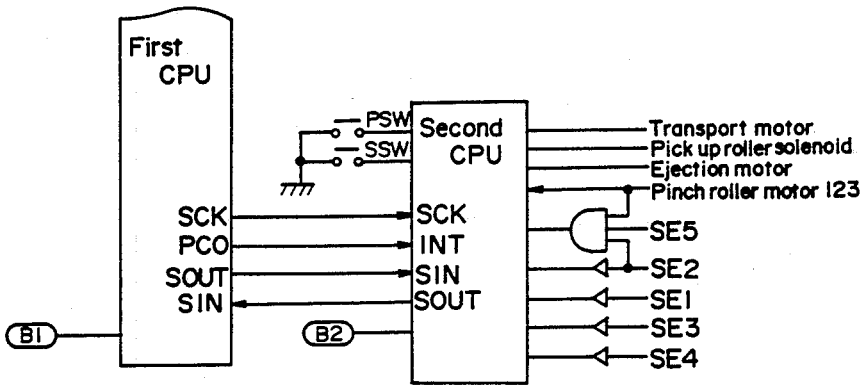

FIGS. 7*a* and 7*b* show the input/outputs of the first CPU 201 that controls the copying machine 1, as well as of the second CPU 202 that controls the ADF 100, wherein the CPUs 201 and 202 are connected with each other to enable synchronized operation.

To the input/output ports on the first CPU 201 are connected the key switches 151 through 159 on the operation panel, as well as a switch matrix 203 including the microswitches SW1 through SW10 on the sheet feeding portion; and via the switch matrix 203 and a decoder 205, the display segment 160 a matrix 204 of the indication LEDs. From the output ports on the first CPU 201 are output on/off signals to a main motor, a developing motor and the like within the copying machine 1. A pulse signal of the main motor is input to a terminal B1.

To the input ports on the second CPU 202 are connected the detection switch PSW that detects elevating of the ADF 100, the ADF start switch SSW, the sensors SE1 through SE4 that detect document feeding, and the sensor SE5 that detects the rotation of the pinch roller motor 123. To the output ports on the second CPU 202 are connected the pick up roller 112, a feeding motor that drives the separation rollers 113 and 114, a transport motor that drives the transport belt 125, a solenoid that moves, the upper pick up roller 112 vertically, a discharge motor that drives the discharge rollers 131 through 134. A pulse signal of the transport motor is input to a terminal B2.

A clock terminal SCK for data sampling and outputting, an interruption output terminal PCO, a data output terminal SOUT and a data input terminal SIN, each on the first CPU 201 are connected, correspondingly, to a clock input terminal SCK, an interruption input terminal INT, a data input terminal SIN and a data output terminal SOUT, each on the second CPU 202.

(Control Procedure)

The control procedure of the first embodiment is hereunder described in detail referring to the attached FIG. 8 through FIG. 19.

In the following paragraphs, the term "on-edge" is defined as change in status, where the switch, sensor, signal or the like changes from the OFF status to the ON status. In contrast, the term "off-edge" represents change in status, where the switch, sensor, signal or the like changes from the ON status to the OFF status.

Figure 8:
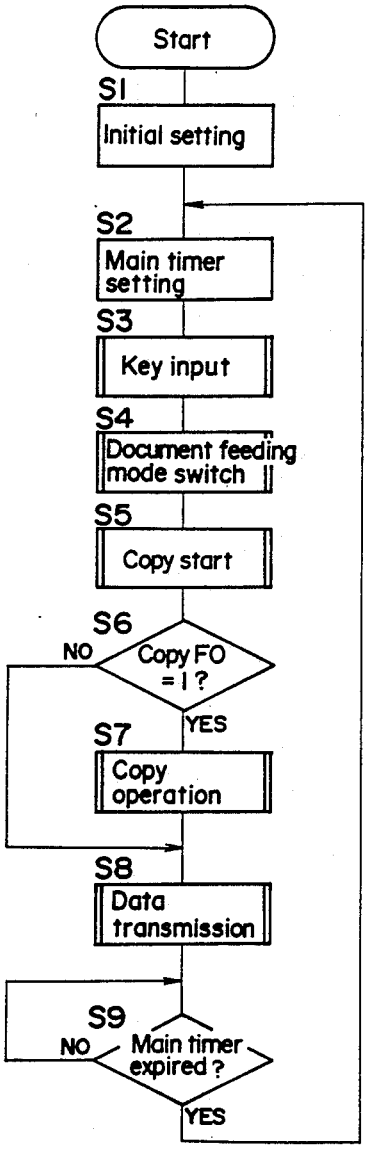

FIG. 8 is a flow chart showing a main routine of the first CPU 201, wherein the copying machine 1 is controlled When the first CPU 201 is reset, the program is started. At step S1, the first CPU 201 clears the random access memory and various registers built in it, and sets the initial mode for each device.

First, the flags used in the routines hereunder described are as follows:

Copy flag FO: a flag that indicates the copying machine 1 is in operation, and remains at "1" during a period from the completion of copy start process and until the completion of copying.

Mode flag F1: a flag that indicates a document feeding mode on the ADF 100, and is set by the feeding mode selection key 159, where the flag indicates the single feeding mode when is reset to "0", and the dual feeding mode when is set to "1".

Feeding flag F2: a flag that indicates the number of documents actually transported to the platen glass 19; indicates one document when is reset to 0, and indicates two documents when is set to "1"; even under the dual feeding mode, if a total number of documents is an odd number, the status of this flag F2 is "0" while a final document is transported; the feeding flag F2 is set by a signal from the second CPU 202 for a number of fed document.

The next routines are hereunder described. At step S2, a main timer on the first CPU 201 is set. The main timer counts the time required for the main routine. The count of the main timer is preset by the initialization, at step S1.

Subroutines at steps S3 through S5 are sequentially called. Step S3 is a subroutine for processing key input, where data are entered with the ten key portion 152, the size data for copy sheets in the cassettes 30 and 35 are stored into the internal RAM, the copy mode selection with the copy mode selection key 155, and the magnification setting with the magnification setting key 156. Step S4 is a subroutine for processing the switching of document feeding mode, wherein the selection of the document feeding mode of the ADF 100 by the feeding mode selection key 159 is treated. Step S5 is a subroutine for processing copy start, wherein the initiation of copying operation is processed.

At step S6, whether the copy flag F0 is set to "1" is judged. If the flag F0 is reset to "0", the processing Preceeds to step S8; if the flag F0 has been reset to "1", the processing proceeds to step S7 where a subroutine for carrying out actual copying operation is executed and the processing proceeds to step S8. At step S8, data transmission to and from the second CPU 202 is processed. The signals transmitted during step S8 are as follows: signals from the first CPU 201 to the second CPU 202 are copying operation in progress signal, document feeding mode signal, and document replace signal that is generated at the completion of image exposure scanning for a designated number of copying cycles. From the second CPU 202 to the first CPU 201, the following signals are transmitted:

A0F mode signal: a signal to be set to "1" when documents are in the document tray 111, and reset to "0" when a final document has been ejected, under the condition that copying operation is in progress and the ADF 100 not in operation.

Setting complete signal: a signal being output once a document is fed to and placed on the specified position on the platen glass 19.

Document size signal: a code signal for document size detected by the sensors SE3 and SE5 on ADF 100.

Feeding number signal: a signal that indicates a number of documents fed onto the platen glass 19.

Inhibition signal: a signal being output when a size of document being fed is irrelevant for copying.

Once the processing in the above subroutines is complete, the processing proceeds to step S9, where the duration of previously mentioned main timer elapses, and then, the Processing returns to step S2. The duration of the one routine is used as a standard for the counting cycles of various times used in the respective timers. In other words, the completion of counting cycle of the respective timers are judged based on how many times this one routine has been repeated.

Figure 9:
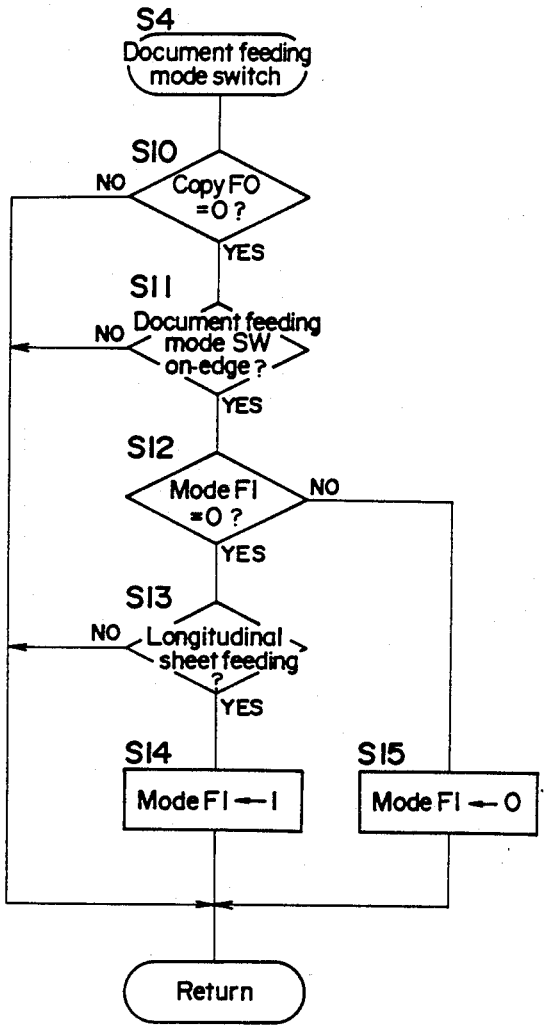

FIG. 9 is a flow chart showing the subroutine at step S4 in the main routine, where processing for switching document feeding mode is executed.

At step S10, whether the copy flag F0 is reset to "0" is judged; if the copy flag F0 is set to "1" i.e. the copying operation is in progress, the processing returns to the mainroutine; if the flag F0 is reset to "0", the processing proceeds to step S11, where whether the status of the document feeding mode selection switch 159 is "on-edge" is judged. If the current status is not "on-edge", the processing returns to the main routine. When the status has been "on-edge", the processing proceeds to step S12, where whether the status of the mode flag F1 is at "0" is judged. If the mode flag F1 has been reset to "0", that is, the single feeding mode has been designated, the processing proceeds to step S13, where whether the longitudinal feeding has been selected as the copy sheet feeding mode is judged. If the latitudinal feeding has been selected, the processing returns to the main routine; if the longitudinal feeding has been selected, the processing proceeds to step S14, where the mode flag F1 is set to "1" i.e. the dual feeding mode has been designated. In the dual feeding mode, a document image becomes longer in the longitudinal direction (the direction of image scanning), making the latitudinal positioned irrelevant. Accordingly, the dual feeding mode is enabled only when the longitudinal sheet feeding has been selected.

If the mode flag F1 is judged to be at "1", the mode flag F1 is reset to "0" at step S15, which means that the single feeding mode is selected.

Figure 10:
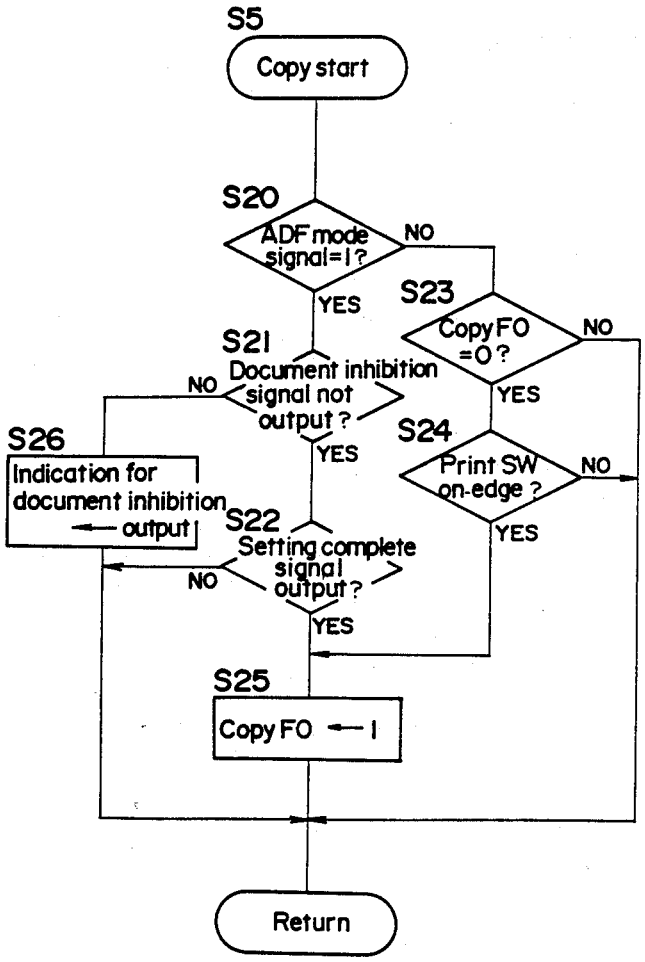

FIG. 10 is a flow chart showing the subroutine at step S5 in the main routine, where processing for copy start is executed.

At step S20, whether the status of ADF mode signal is at "1" is judged. If this signal has been set to "1" i.e. the copying operation using the ADF 100 has been selected (refer to step S123), the processing proceeds to step S21, where whether the document inhibition signal is not being output is judged. If the document inhibition signal has not been output, whether the setting complete signal is being output is judged at step S22. If the setting complete signal is not being output, the processing changes to the standby status; once this signal has been output i.e. a document is placed onto the specified position on the platen glass 19 (refer to steps S170 and S212), the copy flag F0 is set to "1" at step S25

At step S21, if the document inhibition signal is judged to be output (refer to step S206), the inhibition indication is output and the copying operation is inhibited at step S26.

At step S20, if the ADF mode signal is judged to be reset to "0", then, at step S23, after the confirmation of the copy flag F0 being reset to "0", whether the status of the print switch 151 is "on-edge" is judged at step S24. Once the status of the print switch 151 has changed to "on-edge", the copy flag F0 is set to "1" at step S25.

As described above, setting the copy flag F0 to "1" initiates the copying process, at step S8. The control of copying process, being well known in the art, is not described here.

Figure 11:
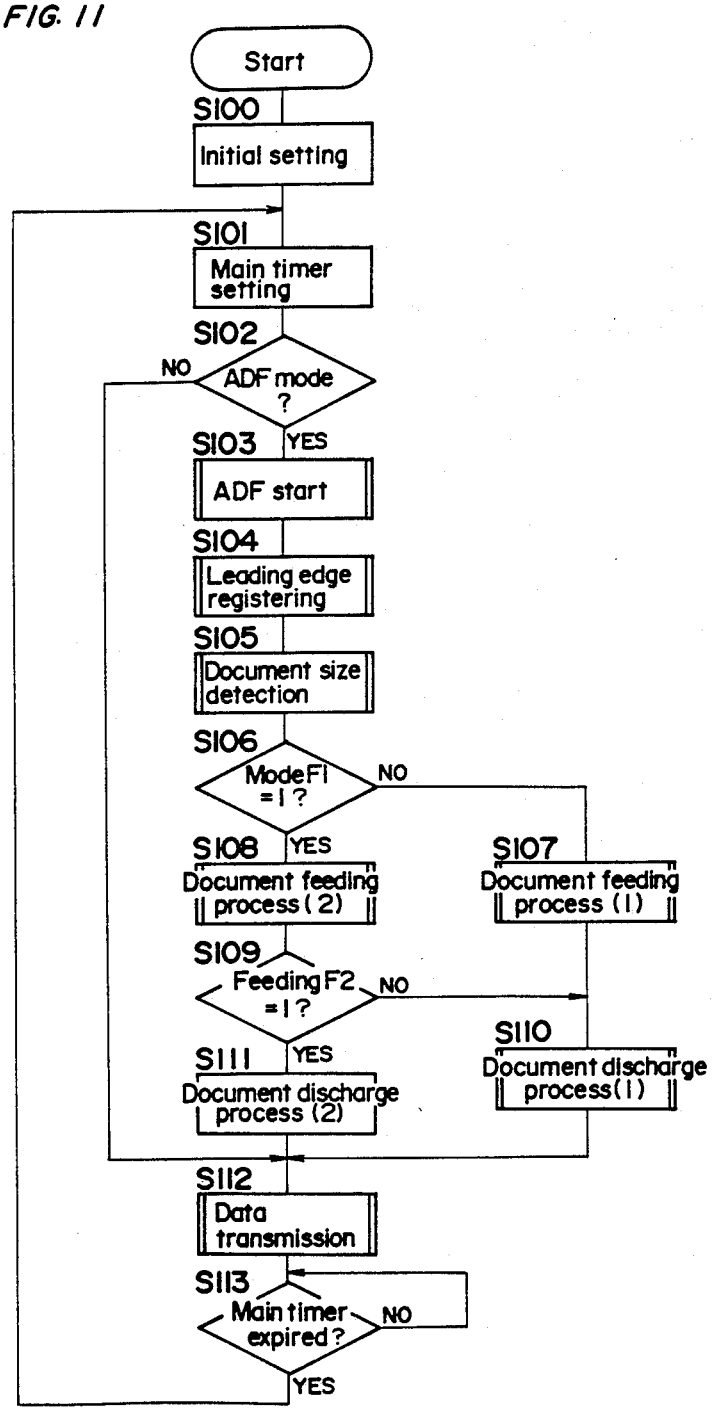

FIG. 11 is a flow chart showing a main routine of the second CPU 202, wherein the ADF 10 is controlled.

When the second CPU 202 is reset, the program is started. At step S100, the second CPU 202 clears the random access memory and various registers built in it, and sets the initial mode for each device.

The flags used in the routines hereunder described are as followed.

The copy flag F0, the mode flag F1, and the feeding flag F2 identical with those used for controlling the first CPU 201.

ADF operation flag F3: a flag that indicates that the ADF 100 is in operation, and remains at "1" after the initiation of document feeding, until the discharge of a final document.

ADF feeding flag F4: a flag that indicates that the ADF 100 is feeding a document, and remains at "1" after the initiation of document feeding, until the placement of document to the specified position on the platen glass 19.

Leading edge register flag F5: a flag that indicates that the leading edge is being registered, and remains at "1" after the initiation of feeding for the first and second documents, until the completion of the leading edge registering.

Leading edge register start flag F6: a flag that indicates timing to initiate the leading edge registering, and remains at "1" after the initiation of feeding for the first and second documents, until the feed motor and the pick up roller 112 are actuated.

Wait flag F7: a flag that indicates that a document stays at the leading edge registering position, and remains at "1" after the completion of the leading edge registering process, until the resumption of document feeding toward the platen glass 19.

Setting complete flag F8: a flag that indicates that a document fed from the document tray 111 is positioned in the specified position on the platen glass 19, and remains at "1" after the completion of feeding to the platen glass 19, until the initiation of a document discharge from the platen glass 19.

Discharge flag F9: a flag that indicates that a document is being discharged from the platen glass 19 to the discharge tray 135, and remains at "1" after the output of the document replace signal, until the completion of document discharge.

Document flag F10: a flag that indicates that whether a document being fed in the dual feeding mode is the first or second document, wherein if the status of the flag is at "0", the document is the first document in the pair; and if "1", the document is the second document in the pair.

The next routines are hereunder described. At step S102, whether the current mode is the ADF mode is judged. If "NO", the processing proceeds to step S112; if "YES", the subroutines at steps S103 through S105 are called sequentially. At step S103, a process for detecting the "on-edge" of ADF start switch SSW is detected so as to initiate the operation of the ADF 100. At step S104, the leading edge registering i.e. a process for feeding a document from the document tray 111 to the leading edge registering position on the pinch rollers 121 and 122, is executed. At step S105, a process for detecting a size of document fed from the document tray 111 is executed.

At step S106, whether the status of the mode flag F1 is at "1" is judged. If the mode flag F1 is reset to "0" i.e. the current mode is the single feeding mode, the subroutines at steps S107 and S110 are called, and the processing proceeds to step S112. At step S107, a process to feed documents one by one to the platen glass 19 is executed. At step S110, a process to discharge one document to the discharge tray 135 is executed.

if the mode flag F1 is judged to be at "1" at step S106 i.e. the current mode is the dual feeding mode, the subroutine at step S108 is executed, thereby a process for feeding a pair of documents is sequentially onto the platen glass 19 is executed. At step S109, whether the status of the feeding flag F2 is at "1" is judged. If the current status is at "1", the subroutine at step S111 is executed, thereby a pair of documents are sequentially discharged onto the discharge tray 135, and the processing proceeds to step S112. If the feeding flag F2 is reset to "0", the subroutine at the above-mentioned step S110 is executed and the processing proceeds to step S112.

At step S112, input/output data to and from the first CPU 201 are processed the signals transmitted at step S112 are identical with those described in the processing at the above-mentioned step S8.

Upon completing these subroutines, the processing returns to step S101 once the previously mentioned main timer completes the counting cycle. The duration of the one routine is used as a standard for the counting cycles of various times used in the respective times.

Figure 12:
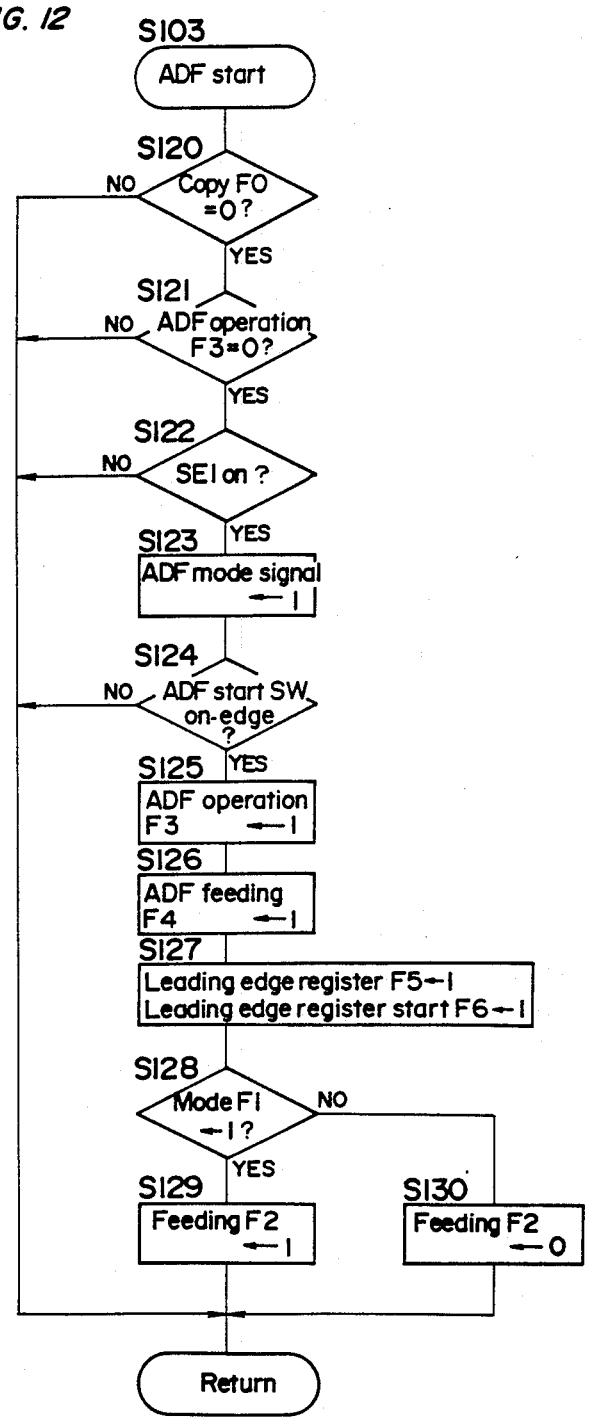

FIG. 12 is a flow chart showing the subroutine at step S103 in the main routine of the second CPU 202, where the ADF start process is executed.

First, at step S120, whether the copy flag F0 is reset to "0" is judged; at step S121, whether the ADF operation flag F3 is reset to "0" is judged; at step S122, whether the status of the sensor SE1 on the document tray 111 is at on is judged. If any one of the above three criteria is judged to be "0" or "NO", the processing immediately returns to the main routine. If all three of the above criteria are judged to be "1" or "YES" i.e. the copying operation is not in progress, ADF 100 is not operating, and a document to be fed is remaining on the document tray 111, the ADF mode signal is set to "1" at step S123.

At step S124, once the status of the ADF start switch SSW becomes "on-edge", then, at step S125, the ADF operation flag F3 is set to "1"; at step S126, the ADF feeding flag F4 is set to "1"; at step S127, the leading edge register flag F5 and the leading edge register start flag F6 are set to "1". At step S128, whether the status of the mode flag F1 is at "1" is judged. If judged to be "1", the feeding flag F2 is set to "1" at step S129; if judged to be "0", the feeding flag F2 is reset to "0" at step S130, thus terminating this subroutine.

Figure 13:
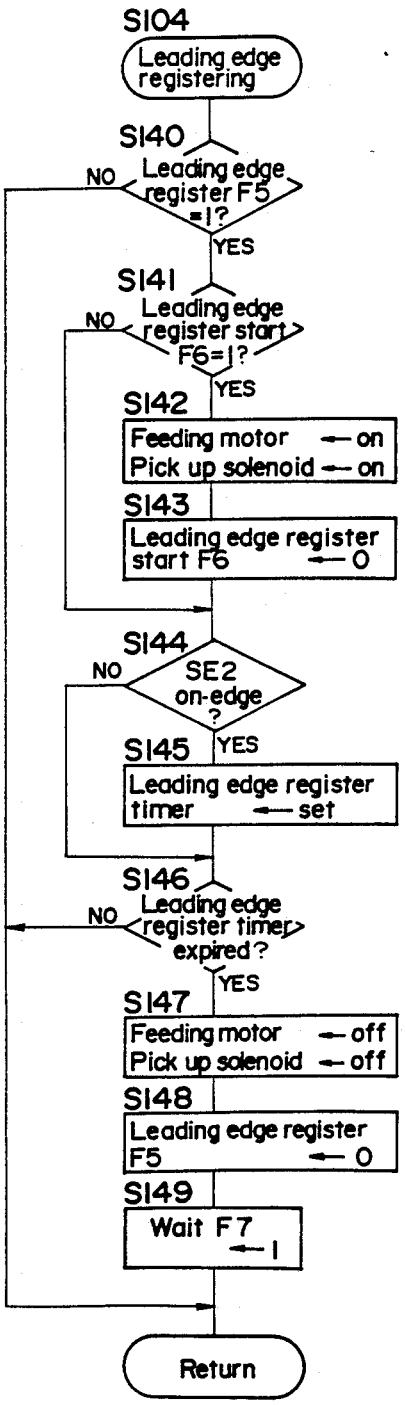

FIG. 13 is a flow chart showing the subroutine at step S104 in the main routine of the second CPU 202, wherein leading edge registering is executed.

At step S140, whether the status of the leading edge register flag F5 is at "1" is judged. If the flag F5 is reset to "0", the processing immediately returns to the main routine; then, if the status is set to "1", whether the status of the leading edge register start flag F6 is at "1" is judged at step 1141. If the flag F6 is reset to "0", the processing proceeds to step S144. If the status of this flag F6 is at "1", the feeding motor and pick-up solenoid are activated at step S142, thereby the pick up roller 112 comes into contract with the uppermost document and rotates, and, at the same time, the separation rollers 113 and 114 start rotation, and the uppermost document only is fed out from the document tray 111 (refer to FIG. 3*a*). Next, at step S143, the leading edge register start flag F6 is reset to "0" and the processing proceeds to step S144.

At step S144, whether the status of the sensor SE2 is "on-edge" is judged. If the status is not "on-edge", the processing proceeds to step S146; if the status has been "on-edge", the leading edge register timer is set at step S145 and the processing proceeds to step S146. The predetermined counting duration of the timer corresponds with a period where the leading edge of a document is detected by the sensor SE2, and, then, the leading edge of the documents comes into contact with the nipping portion between the pinch rollers 121 and 122 and forms a loop. Accordingly, at step S147, the feeding motor and the pick up solenoid are turned off, once the leading edge register timer completes the counting cycle at step S146. At the same time, at step S148, the leading edge register flag F5 is reset to "0", and at step S149, the wait flag F7 is set to "1", thus terminating this subroutine. By the above process, the leading edge of a document fed from the document tray 111 comes into contact with the nipping portion between the pinch rollers 121 and 122, thereby its skew is corrected, and the document temporarily remains stationary in the upstream side of the nipping portion (refer to FIG. 3*b*).

Figure 14:
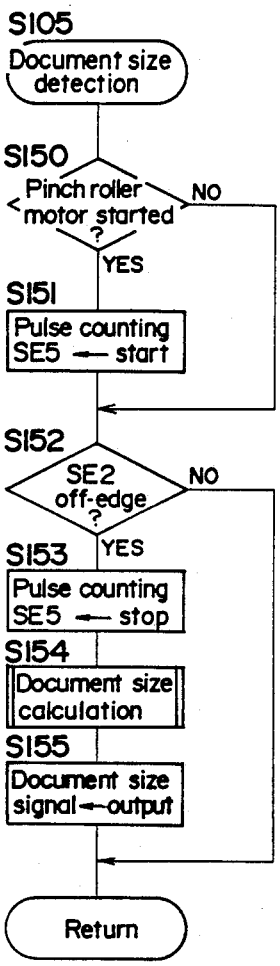

FIG. 14 is a flow chart showing the subroutine at step S105 in the main routine of the second CPU 202, wherein the detection of a document size is processed. This subroutine is executed during a period where a document is fed from the leading edge registering position to the specified position on the platen glass 19, thereby the longitudinal length of document is detected by counting pulses using the sensor SE5, and, in conjunction with the counting results, count, the on/off status of the sensor SE3 for detecting the latitudinal width of document is used to detect the document size.

First, at step S150, whether the pinch roller motor 123 has started is judged. The motor 123 is turned on later, at step S164. If the motor 123 has not yet started, the processing proceeds to step S152. If the motor 123 has started, the pulse counting with the sensor SE5 is started at step S151 and the processing proceeds to step S152. If the sensor SE2 is judged to have been "off-edge", at step S152, the pulse counting is stopped at step S153, thereby at step S154, the document size is arithmetically determined based on the pulse count result and the on/off signal of the sensor SE4. At step S155, the determined document size is output as the document size signal, thus this subroutine is completed.

Figure 15:
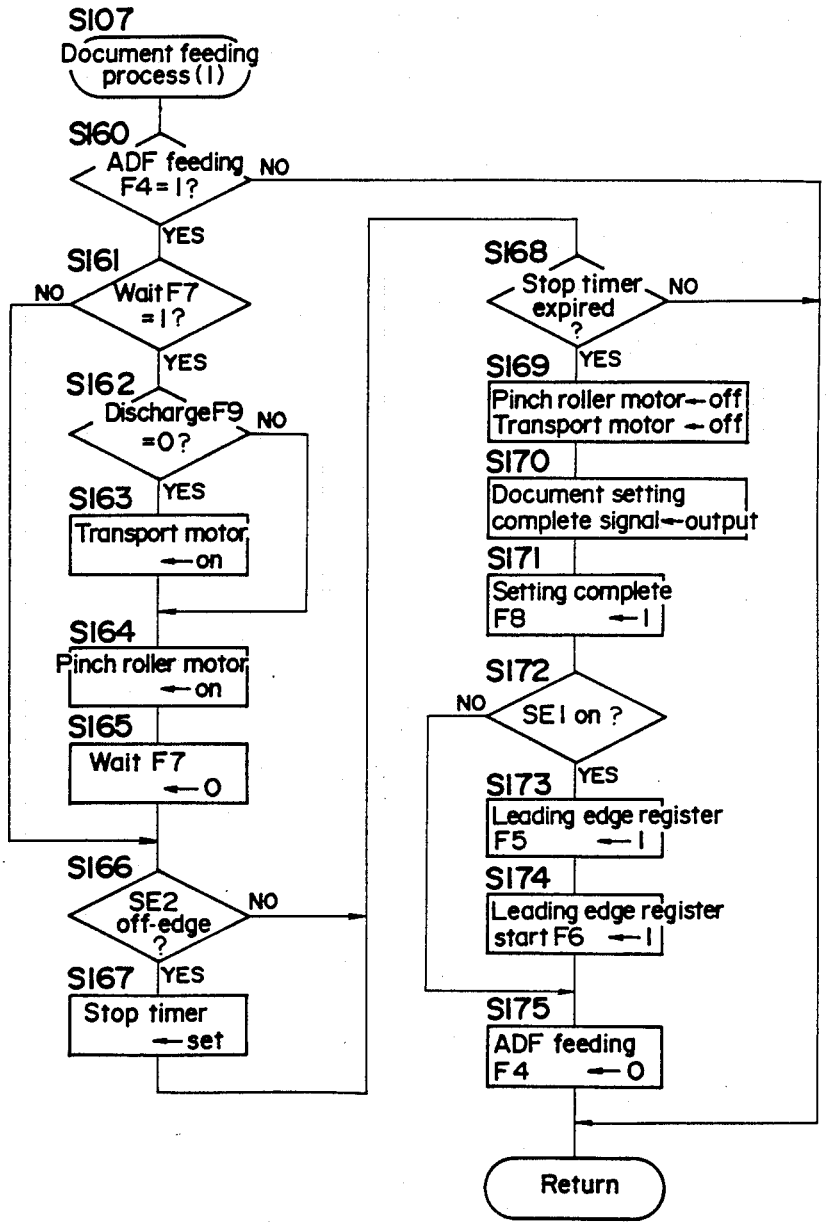

FIG. 15 is a flow chart showing the subroutine at step S107 in the main routine of the second CPU 202, wherein the document feeding process (1) in the single feeding mode is executed.

At step S160, whether the status of the ADF feeding flag F4 is at "1" is judged. If the flag F4 has been reset to "0", the processing immediately returns to the main routine. If the current status of the flag F4 is at "1" i.e once the ADF start switch SSW is turned on, whether the the status of the wait flag F7 is at "1" is judged at step S161. If the wait flag F7 has been reset to "0", the processing proceeds to step S166. If the status of this flag F4 is at "1" i.e. the leading edge of a document has been registered by the pinch rollers 121 and 122, then, whether the status of the discharge flag F9 is at "0" is judged at step S162. If the discharge flag F9 has been already set to "1", the processing proceeds to step S164. If the flag F9 has been reset to "0", a transport motor is turned on at step S163; the pinch roller motor 123 is turned on at step S164; the wait flag F7 is reset to "0" at step S165; and the processing proceeds to step S166. Thus, the document feeding from the leading edge registering position toward the platen glass 19 is resumed.

At step S166, whether the status of the sensor SE2 is "off-edge" is judged. If the current status of SE2 is not "off-edge", the processing proceeds to step S168; if the status of the sensor SE2 is "off-edge", the stop timer is set at step S167 and the processing proceeds to step S168. One counting duration of the stop timer corresponds with a duration from when the trailing edge of a document passes the sensor SE2 when the document reaches the initial exposing position on the platen glass 19. Accordingly, at step S168, once the counting duration of the stop timer elapses, then, at step S169, the pinch roller motor 123 and the transport motor are turned off; at step S170, the document setting complete signal is output to the first CPU 201; and at step S171, the setting complete flag F8 is set to "1". Thus, a documents is fed and placed onto the specified position on the platen glass 19.

At step S172, whether the status of the sensor SE1 is on is judged. If the status is on i.e. a next document to be copied is on the document tray 111, the leading edge register flag F5 is set to "1" at step S173 in order to execute the leading edge registering process with this document. At step S174, the leading edge register start flag F6 is set to "1"; at step S175, the ADF feeding flag F4 is reset to "0", thus this subroutine is completed. At the above-mentioned step S172, if the sensor SE1 is off i.e. document tray 111 is empty; at step S175, the ADF feeding flag F4 is reset to "0", thus this subroutine is completed.

Figure 16A:
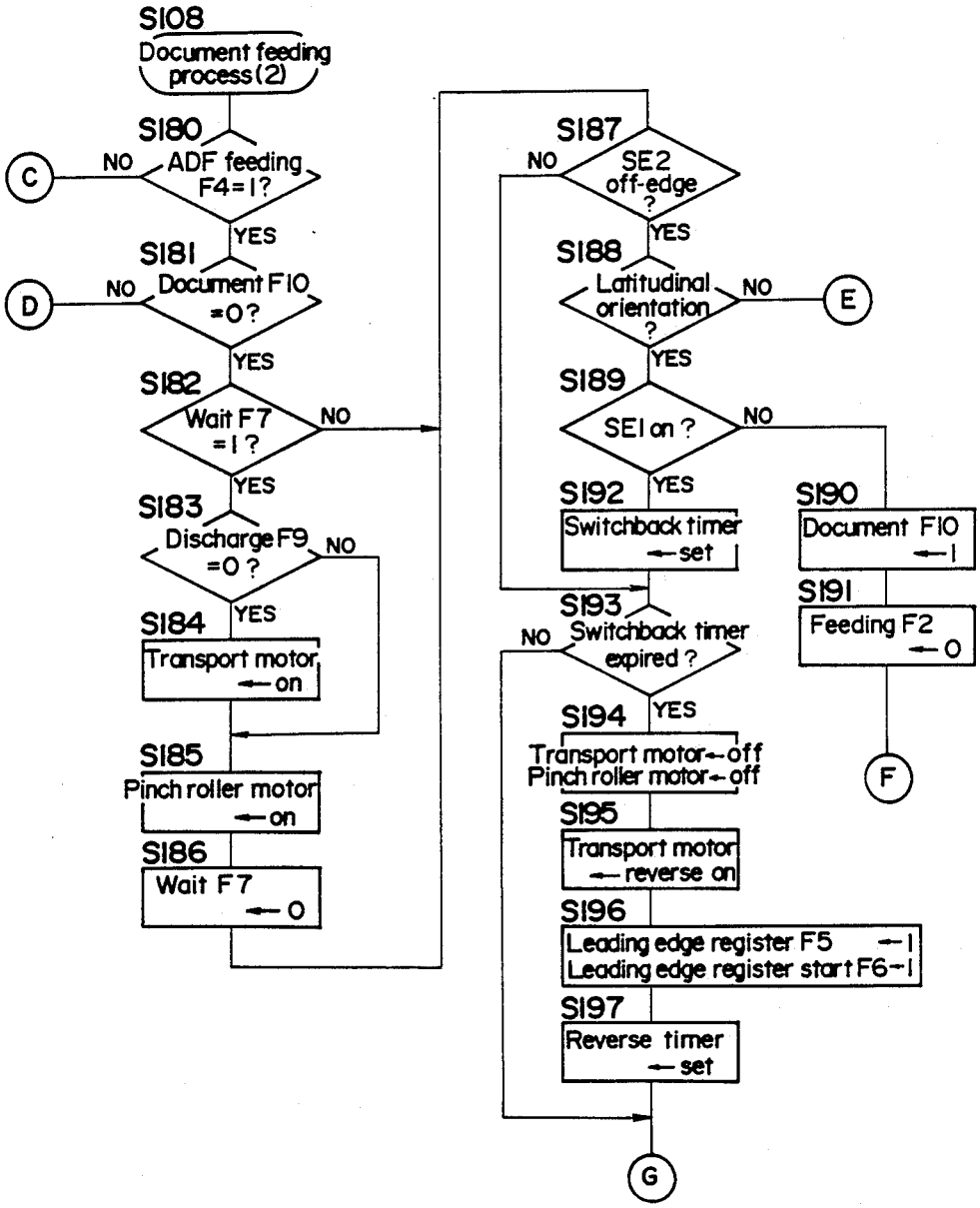
FIGS. 16*a* and 16*b* ar charts showing a subroutine for the document feeding process (2)
Figure 16B:
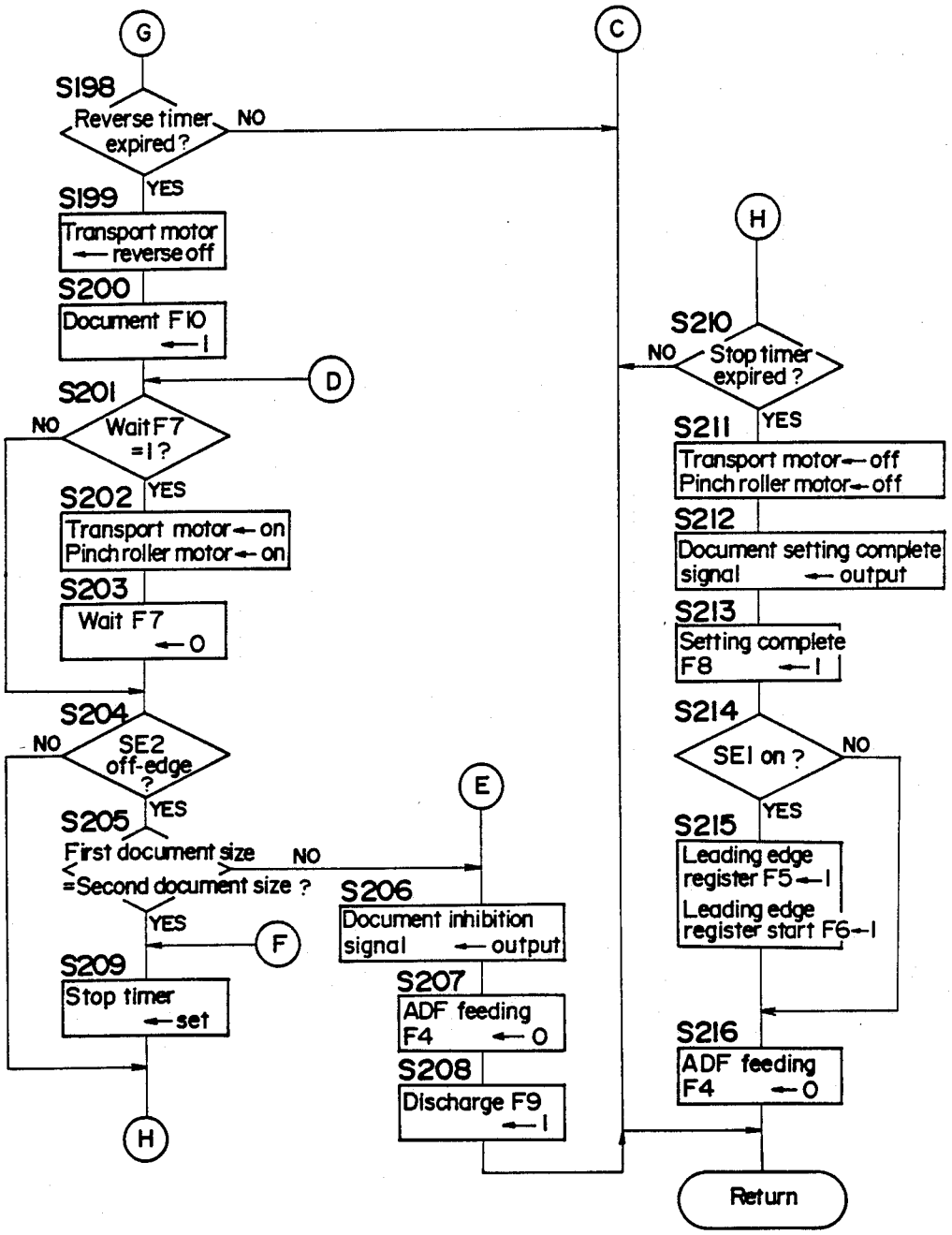

FIGS. 16*a* and 16*b* are flow chart showing the subroutine at step S108 in the main routine of the second CPU 202, wherein the document feeding process (2) in the dual feeding mode is executed. In this subroutine, the dual feeding process is executed only when the first and second documents are of a common size and both are fed latitudinally (for example, A4 size latitudinal orientation or B5 size latitudinal orientation). When documents of other sizes or orientation are fed, the copying operation is inhibited and the documents are discharged.

First, at step S180, whether the status of the ADF feeding flag F4 is at "1" is judged. If the flag F4 is reset to "0", the processing immediately returns to the main routine. If the current status of the flag F4 is at "1" i.e. once the ADF start switch SSW is turned on, whether the status of the document flag F10 is "0" is judged at step S181.

if the document flag F10 has been set to "1" i.e. a document to be fed is a second document of a pair, the processing proceeds to step S201. If the document flag F10 has been reset to "0" i.e. a document to be fed is a first document of a Pair, whether the status of the wait flag F7 is at "1" is judged at step S182. If the wait flag F7 has been reset to "0", the processing proceeds to step S187. If the wait flag F7 has been set to "1" i.e. the leading edge of the first document has been already registered, then, at step S183, whether the status of the discharge flag F9 is at "0" is judged. If the discharge flag F9 has been set to "1", which means that the document discharge process is under way for a pair of documents and the transport motor has been already turned on, the processing proceeds to step S185. 1f the discharge flag F9 has been reset to "0", the transport motor is turned on at step S184; the pinch roller motor 123 is turned on at step S185; the wait flag F7 is reset to "0" at step S187. The processing then Proceed to step S187. Thus, the feeding of a first document from the leading edge registering position toward the platen glass 19 is resumed (refer to FIG. 3*c*).

At step S187, whether the status of the sensor SE2 is "off-edge" is judged. If the status of the sensor SE2 has been "off-edge"; at step S188, whether the latitudinal orientation of the document feeding is to be performed is judged. If the longitudinal orientation has been selected, the document image becomes too large to be copied to a sheet. Accordingly, at step S206, the document inhibition signal is output onto the first CPU 201, and, at step S207, the ADF feeding flag F4 is reset to "0"; at step S208, the discharge flag F9 is set to "1" in order to instruct the document to be discharged. The processing then returns to the mainroutine. If the latitudinal orientation of the document feeding is performed, then, at step S189, whether the status of the sensor SE1 is on is judged. If the status is not on i.e. the second document of a pair is not in the document tray 111, and the document presently fed is the final document to be copied, then, at step S190, the document flag F!0 is set to "1" in order to process the document as a second document of a pair, thereby at step S191, the feeding flag F2 is reset to "0", and the processing proceeds to step S209.

if the status of the sensor SE1 is already on at the previously mentioned step S189 i.e. a second document of a pair is in the document tray 111, a switchback timer is set at step S192. The counting duration of the switchback timer corresponds with a duration between the time when the trailing edge of a document is detected by the sensor SE2 and the time when the document completely passes through the nipping portion between the pinch rollers 121 and 122.

At step S193, whether the counting duration of the switchback timer has elapsed is judged. If the duration has not elapsed, the processing proceeds to step S198. If the duration has elapsed, the transport motor and the pinch roller motor 123 are turned off at step S194 (refer to FIG. 3*d*). At step S195, the transport motor is turned on for the reverse movement to feed the first document backward to the pinch rollers 121 and 122. At step S196, the leading edge register start flag F6 is set to "1" to prepare the leading edge registering for the second document. Simultaneously, the reverse timer is set at step S197, and the processing proceeds to step S198. The counting duration of the reverse timer is a duration from the start of the reverse feeding of a document to the time when the trailing edge of the document becomes in contact with the nipping portion between the pinch rollers 121 and 122 that register the trailing edge.

At step S198, once the counting duration of the reverse timer elapses, then, at step S199, the transport motor turns off to stop its reverse rotation, thereby at step S200, the document flag F10 is set to "1" in order to process the second document onwards. Thus, the trailing edge of the first document being in contact with the nipping portion between the pinch rollers 121 and 122 are registered, thereby the document waits further process.

Next, at step S201, whether the status of the wait flag F7 is at "1" is judged i.e. whether the leading edge registering process for the second document has finished is judged. If the wait flag F7 has been reset to "0", the processing proceeds to step S204. If the wait flag F7 has been set to "1" i.e. the leading edge registering for the second document has completed in the above-mentioned subroutine at step S104 (refer to step S149), the transport motor and the motor 123 are turned o at step S202; the wait flag F7 is reset to "0" at step S203 and then the processing proceeds to step S204. Thus, the first and second documents are sequentially fed onto the platen glass 19 (refer to FIGS. 3*g* and 3*h*).

At step S204, whether the status of the sensor SE2 is "off-edge" is judged. If the current status is not "off-edge", the processing proceeds to step S210. If the status has been "off-edge", whether the size of the second document is same as the size of the first document is judged at step S205, when the trailing edge of the second document passes the sensor SE2. If the second document size is not same as the first document size, that is, a problem may occur when the pair of documents have different sizes, the document inhibition signal is output to the firs CPU 201 at step S206; the ADF feeding flag F4 is reset to "0" at step S207; the discharge flag F9 is set to "1" at step S208 to instruct that the documents to be discharged. Then, the processing returns to the main routine. If the first and second documents are same in size, the stop timer is set at step S209 and the processing proceeds to step S210. The stop timer is identical with that set at step S167. At step S210, once the counting duration of the stop timer elapses, then, at step S211, the transport motor and the pinch roller motor 123 are turned off; at step S212, the document setting complete signal is output to the first CPU 201; and at step S213, the setting complete flag F8 is set to "1". Thus, the pair of documents are serial-sequentially fed onto the specified position on the platen glass 19 and positioned there (refer to FIG. 3*i*).

Next, at step S214, whether the status of sensor SE1 is on is judged. If the current status is not on i.e. the follows documents are in the document tray 111; at step S215, the leading edge register flag F5 and the leading edge register start flag F6 are set to "1" in order to process of the leading edge registering the next document as a first document of a pair. Then, at step S216, the ADF feeding flag F4 is reset to "0", thus this subroutine is completed.

Figure 17:
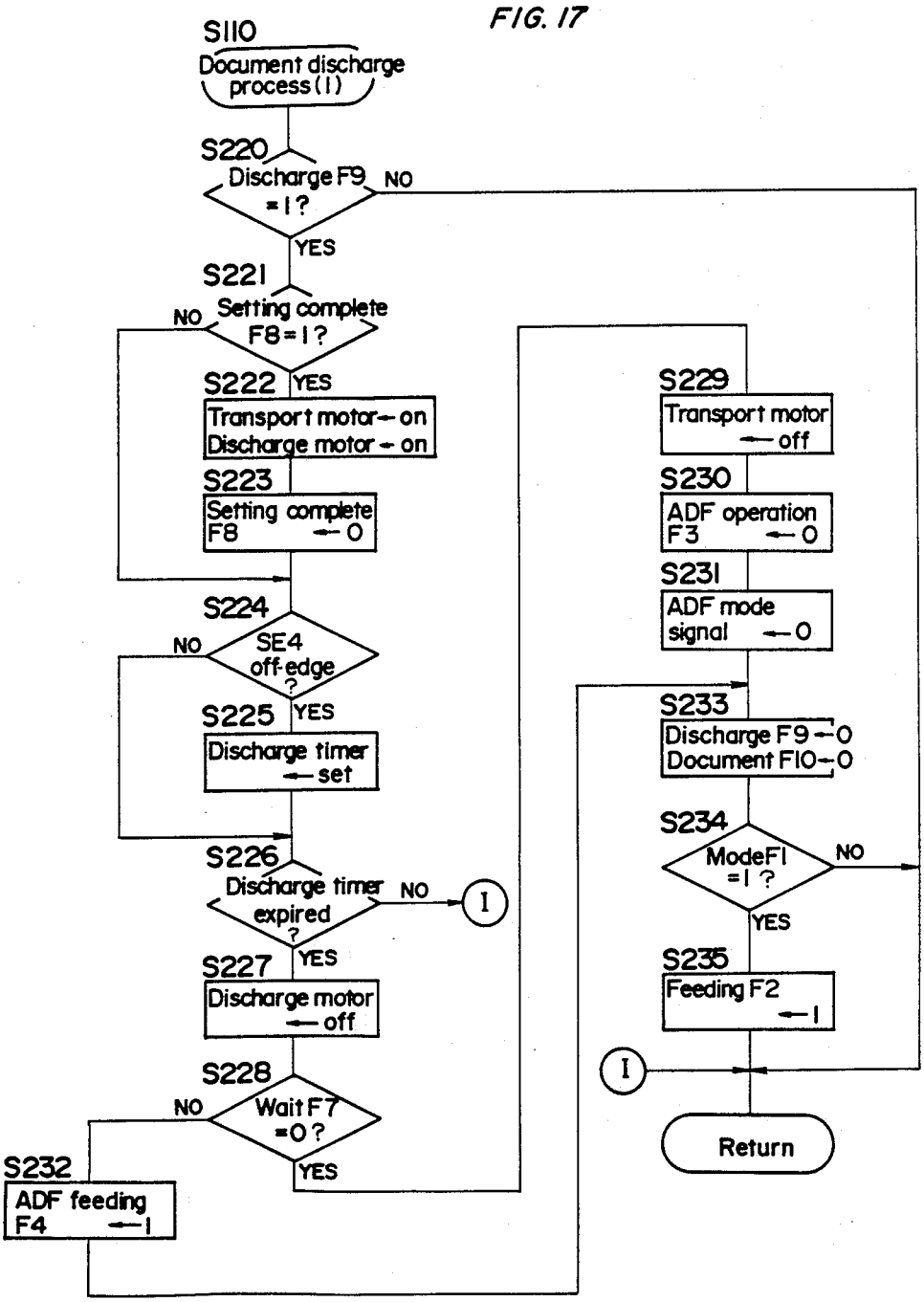

FIG. 17 is a flow chart showing the subroutine at step S110 in the main routine of the second CPU 202, wherein the document discharge process (1) in the single feeding mode is executed. This process is executed when the single feeding mode is selected, or when the final document of the odd number of documents is fed in the dual feeding mode, or a first document is judged to be improper for the copying in the dual feeding mode (judged "NO" at step S188).

First, at step S220, whether the status of the discharge flag F9 is at "1" is judged. The discharge flag F9 is set to "1" once the document replace signal Is output when the image exposure-scanning for a predetermined number of copies completes. Accordingly, when the status of the discharge flag F9 remains set to "0", the processing immediately returns to the main routine. If the discharge flag F9 has been set to "1", whether the status of the setting complete flag F8 is at "1" is judged at step S221. If the setting complete flag F8 is reset to "0", the processing proceeds to step S224. If the setting complete flag F8 has been set to "1", the transport motor and the discharge motor are turned on at step S222, thereby the setting complete flag F8 is reset to "0" at step S223, and the processing then proceeds to step S224. Thus, the discharge of a document positioned on the platen glass 19 is initiated.

At step S224, whether the status of the sensor SE4 is "off-edge" is judged i.e. whether the trailing edge of a document has passed the sensor SE4 is judged. If the status is not "off-edge", the processing proceeds to step S226. 1f the status has been "off-edge", the discharge timer is set at step S225 and the processing proceeds to step S226. The counting duration of the discharge timer corresponds with a duration from when the trailing edge of the document is detected by the sensor SE4 and to when the document passes through the discharge rollers 133 and 134. Accordingly, at step S226, the counting duration of the discharge timer elapses; and at step S227, the discharge motor is turned off. Thus, a document is discharged onto the discharge tray 135.

Next, at step S228, whether the status of the wait flag F7 is at "0" is judged i.e. whether the next document is waiting at the leading edge registering position is judged. If the wait flag F7 has been set to "1", then, at step S232, the ADF feeding flag F4 is set to "1" in order to execute the feeding process, thereby the processing proceeds to step S233. If the wait flag F7 has been reset to "0" i.e. a document discharged is the final document of the stacked documents to be copied, the transport motor is turned off at step S229. Then, at step S230, the ADF operation flag F3 is reset to "0"; at step S231, the ADF mode signal is reset to "0" and output to the first CPU 201; and the processing proceed to step S233.

At step S233, the discharge flag F9 and the document flag F10 are reset to "0"; at step S234, whether the status of the mode flag F1 is at "1" is judged. If the mode flag F1 has been reset to "0" i.e. the single feeding mode is executed, the processing immediately returns to the main routine. If the mode flag F1 has been set to "1" i.e. the dual feeding mode is executed, at step S235, the feeding mode flag F2 is set to "1", the processing returns to the main routine.

Figure 18:
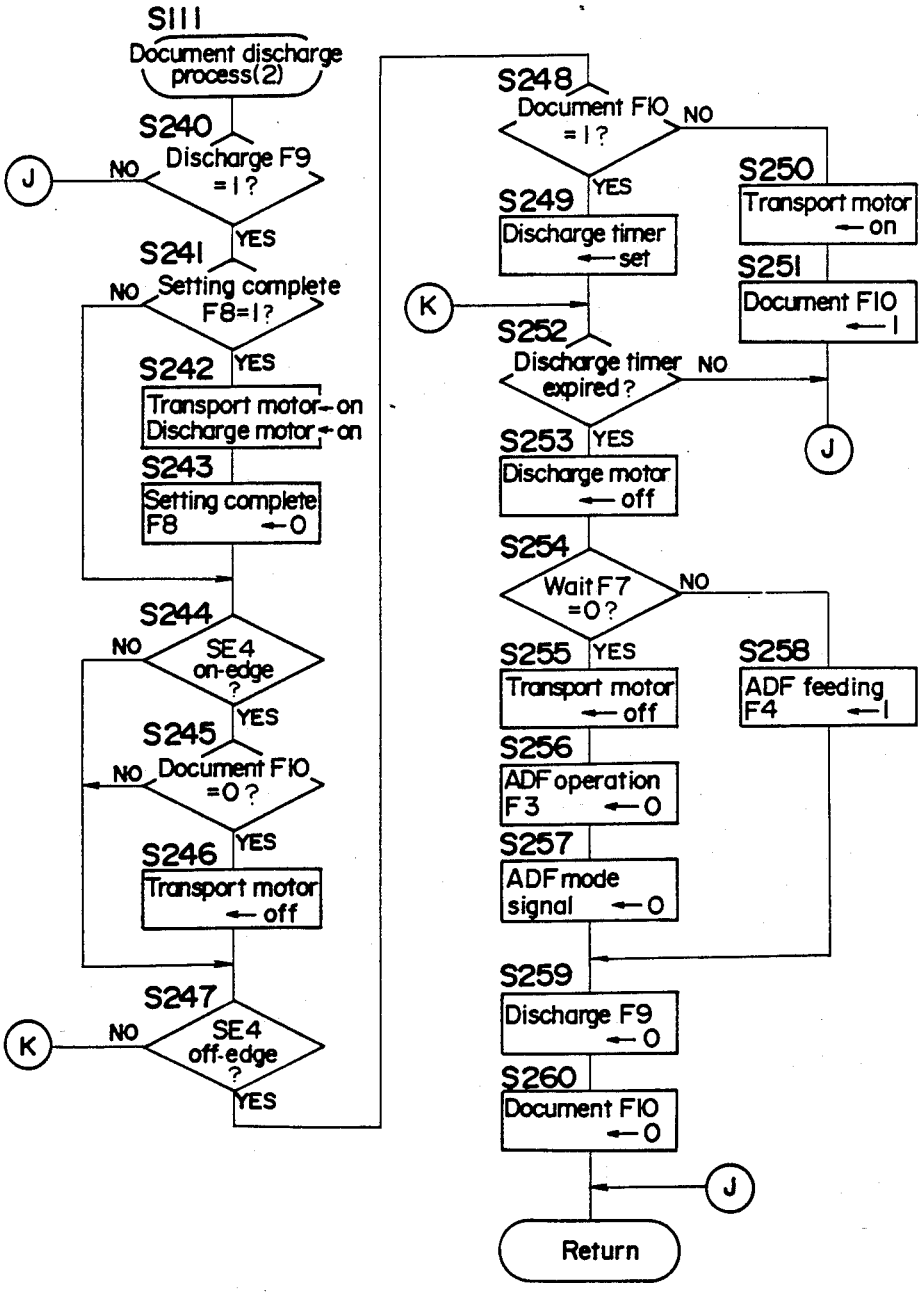

FIG. 18 is a flow chart showing the subroutine at step S111 in the main routine of the second CPU 202, where the document discharge process (2) in the dual feeding mode is executed. In this subroutine, the transport belt 125 temporarily is stopped once a first document is nipped between the discharge rollers 131 and 132 while being discharged, in order to allow a second document to temporarily maintain a position on the platen glass 19 and make an opening among a pair of documents, enabling the pair of documents to be orderly discharged onto the discharge tray 135.

Figure 4A:
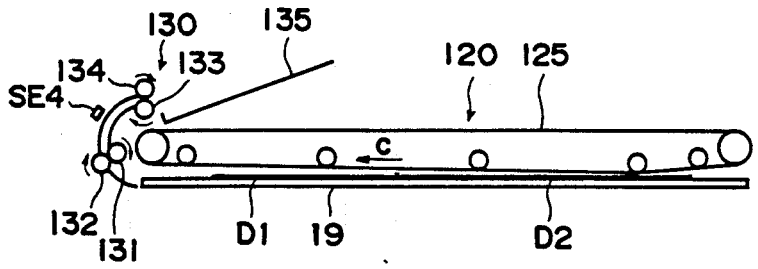
FIG. 4*a* through FIG. 4*e* are explanatory drawings showing the document charging operation.
Figure 4B:
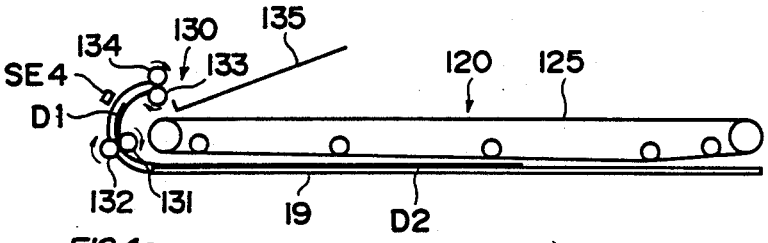
Figure 4C:
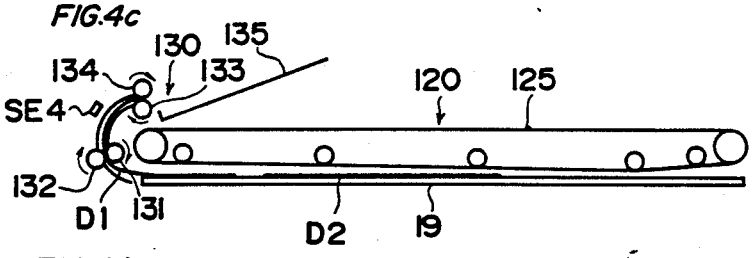
Figure 4D:
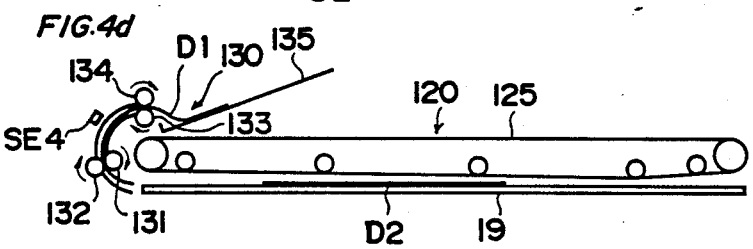
Figure 4E:
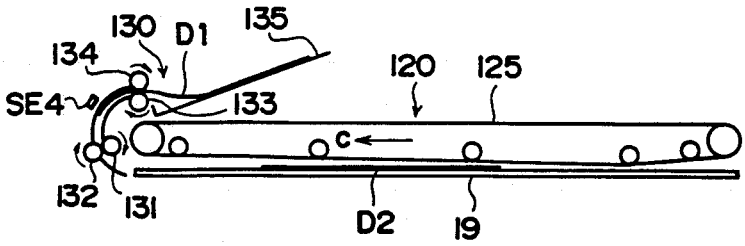

More specifically, step S240 through step S243 are identical with the previously mentioned step S220 through S223, whereby when the discharge flag F9 and the setting complete flag F8 are set to "1", the discharging is initiated (refer to FIG. 4*a*). At step S244, whether the status of the sensor SE4 is "on-edge" is judged. If the status is not "on-edge", the processing proceeds to step S247. If the status has been "on-edge", then, at step S245, whether the status of the document flag F10 is at "0" is judged. If the document flag F10 has been reset to "0" i.e if the document of which leading edge has been detected at step S224 by the sensor SE4 is a first document of a pair, the transport motor is turned off at step S246, and the processing proceeds to step S247. Thus, the first document alone is discharged while the second document maintains its position on the platen glass 19 (refer to FIGS. 4*b*, 4*c* and 4*d*).

At step S247, whether the status of the sensor SE4 is "off-edge" is judged. If the status is not "off-edge", the processing proceeds to step S252. If the status has been "off-edge", then, whether the status of the document flag F10 is at "1" is judged at step S248. When the document flag F10 has been reset to "0" i.e. the document of which trailing edge is detected by SE4 at step S247 is the first document, then, the transport motor is turned on at step S250, and the document flag F10 is set to "1" at step S251, thereby the processing returns to the mainroutine. Thus, discharging the second document remaining on the platen glass 19 is initiated (refer to FIG. 4*e*).

At the previously mentioned step S248, if the document flag F10 is judged to be set to "1" i.e. the document of which trailing edge is detected at step S247 by the sensor SE4 is the second document, the discharge timer is set at step S249, thereby the processing proceeds to step S252.

Step S252 through step S257 are identical with the previously mentioned step S226 through step S231. At these steps, the discharge motor is turned off when the duration of the discharge timer elapses (judged "YES" at step S252; step S253), thereby the feeding process for the next document is initiated (judged "NO" at step S254; step S258), or, if the final document has been discharged, the termination process is executed (judged "YES" at step S254; steps S255, S256 and S257). Subsequently, at step S259, the discharge flag F9 is reset to "0", and at step S260, the document flag F10 is reset to "0", then this subroutine is completed.

Figure 19:
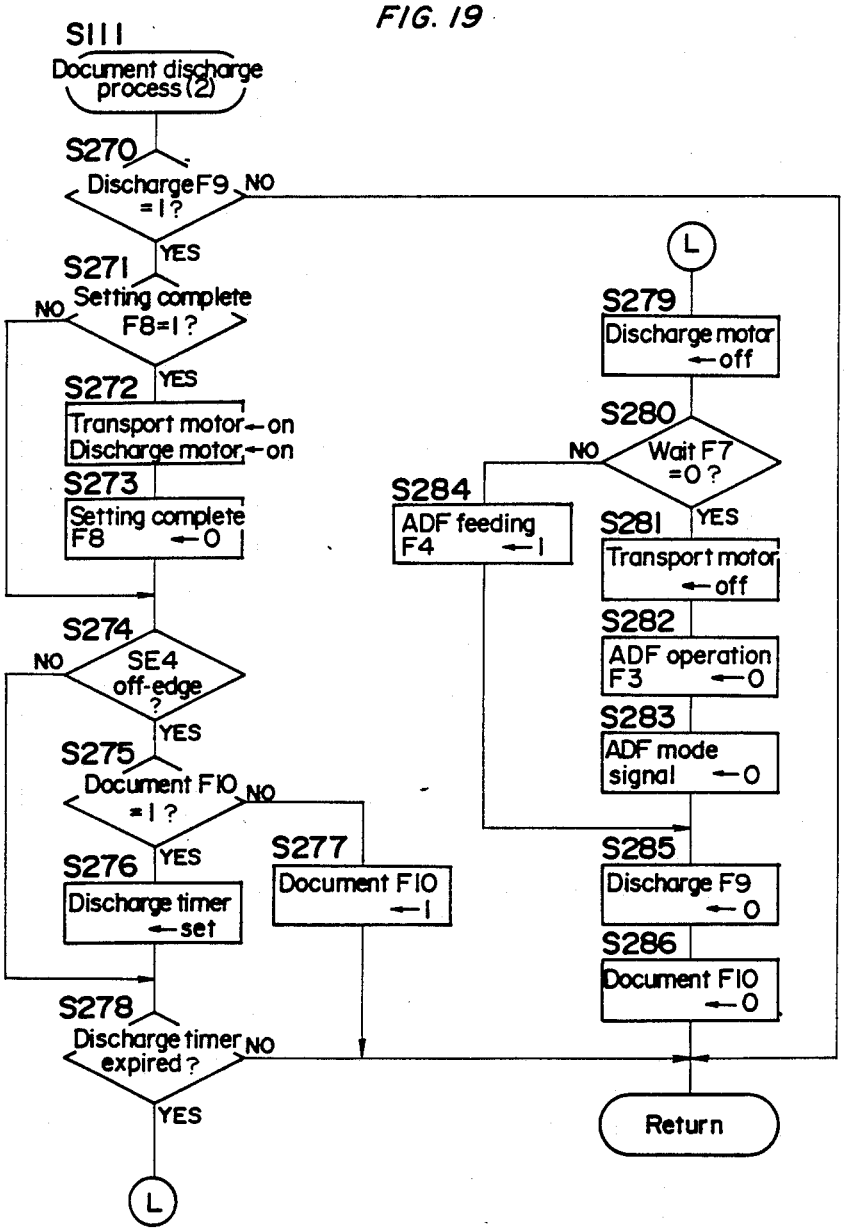
Figure 20A:
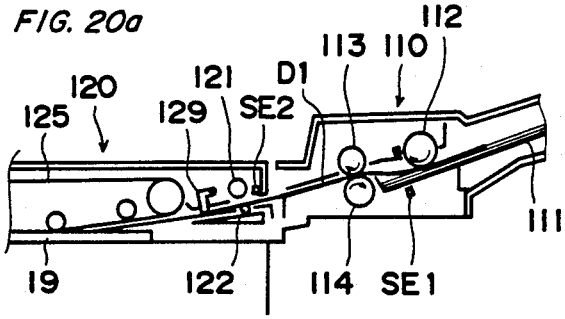
FIG. 20*a* through FIG. 20*d* are explanatory drawings showing the document feeding operation in a second embodiment of the present invention.
Figure 20B:
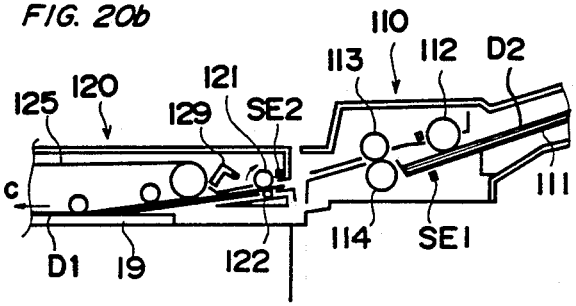
Figure 20C:
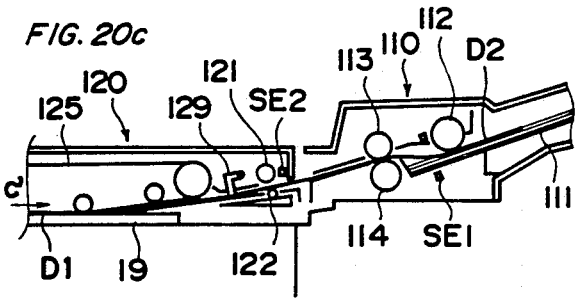
Figure 20D:
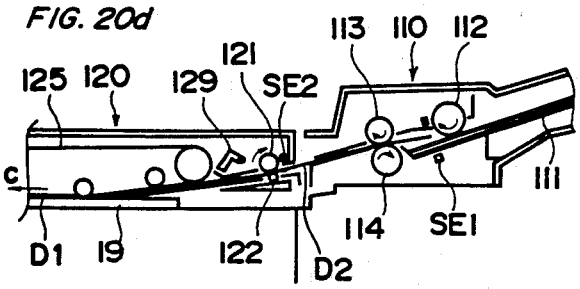

FIG. 19 is a flow chart showing the subroutine at step S111 in the main routine of the second CPU 202, wherein the other document discharge process (2) in the dual feeding is executed. In this subroutine, the document feeding speed of the discharge rollers 131 through 134 is set larger than that of the transport belt 125 so that the pair of documents are orderly discharged onto the discharge tray 135 with an appropriate interval between them. More specifically, step S270 through step S273 are identical with the previously mentioned step S240 through step S243 and step S220 through step S223, whereby the discharge flag F9 and the setting complete flag F8 are set to "1", the discharging is initiated.

Figure 5B:
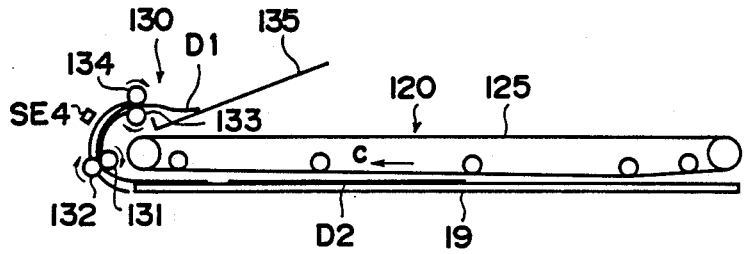
Figure 5C:
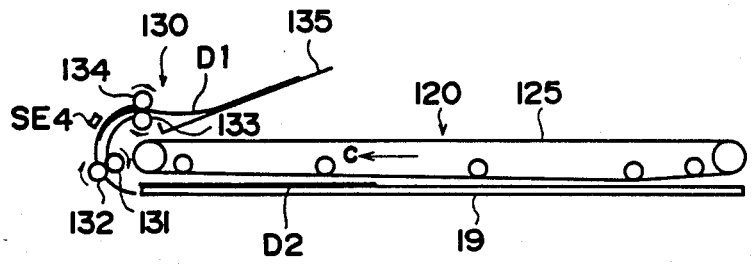

In this case, the document feeding speed of the discharge rollers 131 through 134 is set larger than that of the transport belt 125 so that an opening between a pair of documents gradually enlarges (refer to FIGS. 5*a* and 5*b*).

Next, at step S274, whether the status of the sensor SE4 is "off-edge" is judged. If the status is not "off-edge", the processing Proceeds to step S278 If the status has been "off-edge", then, at step S275, whether the status of the document flag F10 is at "1" is judged. If the document flag F10 has been reset to "0" i.e. if the document of which trailing edge has detected at step S274 by the sensor SE4 is the first document of a pair, then, at step S277, the document flag is F10 is set to "1", thereby the processing returns to the main routine. Next time this subroutine is called, and, if the document flag F10 is judged to have been set to "1" at step S275 i.e. the document of which trailing edge has been detected at step S274 by the sensor SE4 is the second document of a pair, then, at step S276, the discharge timer is set.

Step S278 through step S286 are identical with the previously mentioned step S252 through step S260. At these steps, the discharge motor is turned off when the duration of the discharge timer elapse (judged "YES" at step S278; step S279), thereby the feeding process for the next document is initiated, and this subroutine is completed (judged "NO" at step S280; steps S284, S285 and S286), or, if the final document is discharged, the termination process is executed (judged "YES" at step S280; steps S281, S282, S283, S285 and S286).

[Second Embodiment]

In the above-mentioned first embodiment, the means for registering the leading and trailing edges of a document are the pinch rollers 121 and 122. However, as shown in FIG. 20*a* through FIG. 20*d*, a gate 129 may be used instead. In this second embodiment, the gate 129 is disposed in the down stream side of the document feeding path, and is freely movable either forward or rearward, wherein the upper pinch roller 121 is capable of being pressed onto or detached from the lower pinch roller 122.

With this arrangement, once the dual feeding mode is selected and the ADF start switch SSW is turned on, the upper pinch roller 121 is detached from the lower pinch roller 122 and the gate 129 is inserted into the feeding path. Documents stacked on the document tray 111 are fed one by one, starting with the uppermost document onward, by the rotation of the pick up roller 112, wherein one document is separated from the other by the separation rollers 113 and 114. The leading edge of a document passes through the pinch rollers 121 and 122, and comes into contact with the gate 129 and undergoes the leading edge registering (refer to FIG. 20*a*). Then, the gate 129 retreats from the feeding path, and the upper pinch roller 121 is pressed onto the lower pinch roller 122 and rotated. At the same time, the transport belt 125 is driven forward. Accordingly, a document is transported until its leading edge has passed the gate 129 (refer to FIG. 20*b*).

Next, when the gate 129 is inserted into the feeding path, the upper pinch roller 121 is detached from the lower pinch roller 122. Simultaneously, the transport belt 125 is driven in the reverse direction shown by an arrow c', thereby the first document D1 is transported backward, and the trailing edge thereof comes into contact with the gate 129, so that the trailing edge registering is achieved (refer to FIG. 20*c*). While the first document D1 undergoes trailing edge registering, the second document D2 on the document tray 111 is fed and subjected to the leading edge registering. Thus, the document D1 of which trailing edge registered as well as the document D2 of which leading edge registered are positioned sequentially, intervened by the gate 129.

Once this condition is attained, the gate 129 retreats from the feeding path, and the upper pinch roller 121 is pressed onto the lower pinch roller 122 and rotated. At the same time, the transport belt 125 is driven forward and a pair of the documents D1 and D2 are sequentially fed onto the platen glass 19 (refer to FIG. 20*d*). When the trailing edge of the second document D2 reaches a specified position on the platen glass 19 i.e. the position where exposure scanning using optical system 20 is started, the pinch rollers 121, 122 and the transport belt 125 are stopped.

Additionally, the process described above for setting a document on the specified position on the platen glass 19 is a controlling process that stops document feeding based on the trailing edge detection signal of the sensor. However, such a controlling process may be replaced by a switchback system wherein a document is transported slightly rearward by using a step shape or a movable stopper being disposed in a specified position. More specifically, according to such an arrangement, a document is first fed to the specified position, and then, transported rearward by the reverse movement of the transport belt 125 until the trailing edge of a document comes into contact with the step shape or stopper, thereby the document is placed in the specified position.

Although the present invention has described in connection with the preferred embodiments thereof, it is to be noted that various changes and modifications are apparent to those skilled in the art. Such changes and modifications are to be understood as included within the scope of the present invention as defined by the appended claims, unless they depart therefrom.

What is claimed is:

1. An automatic document feeder capable of serially placing a pair of original documents, fed from document feeding means, at a specified position on a platen in the document feeding direction, and discharging the documents from said platen after the completion of exposure, said automatic document feeder comprising:

a transport belt for transporting documents along said platen; and a discharge roller for discharging documents, discharged from said platen, onto a discharge tray;

wherein the transport velocity of said discharge roller is set greater than that of said transport belt

2. An automatic document feeder capable of serially placing a pair of original documents, fed from document feeding means, at a specified position on a platen in the document feeding direction, and discharging the documents from said platen after the completion of exposure, said automatic document feeder comprising:

a transport belt for transporting documents along said platen;

a discharge roller for discharging documents, discharged from said platen, onto a discharge tray;

detect means for detecting whether a document has reached said discharge roller; and control means that interrupts a discharging operation of said transport belt when said detect means has detected the leading edge of a first document, and that re-starts the discharging operation when said detect means has detected the trailing edge of the first document.

3. An automatic document feeder capable of serially placing a pair of original documents, fed from document feeding means, at a specified position on a platen in the document feeding direction, and discharging the documents from said platen after the completion of exposure, said automatic document feeder comprising:

a transport belt for transporting documents along said platen;

a discharge roller for discharging documents, discharged from said platen, onto a discharge tray;

detect means for detecting whether a document has reached said discharge roller; and control means that interrupts a the discharging operation of said transport belt when said detect means has detected the leading edge of a first document, and that re-starts the discharging operation when a predetermined duration has elapsed.

4. An automatic document feeder for sequentially feeding first and second documents and placing the two documents on an exposure platen side by side, said document feeder comprising:

a document support tray on which a plurality of documents are loaded, said documents including at least the first and second documents;

take-out means for taking the documents one by one out of said document support tray and feeding the documents toward the exposure platen;

a pair of pinch rollers arranged downstream of the take-out means in the document feed direction which forms a nipping portion therebetween, said pair of pinch rollers being selectively rotated in the document feed direction or kept from rotating;

a transport belt arranged downstream of said pair of pinch rollers in the document feed direction and facing the exposure platen, said feeding belt being selectively rotated in the document feed direction, rotated in the reverse direction or kept from rotating, whereby the document is fed in the document feed direction, fed in the reverse direction, or held at a standstill;

control means for controlling said take-out means, pair of pinch rollers and transport belt, said control means including:

first feed control means for driving said take-out means to take the first document out of said document support tray and to feed it toward said pair of pinch rollers and for driving said pair of pinch rollers and said transport belt to rotate in the document feed direction until the trailing edge of the first document is discharged from said pair of inch rollers;

first register control means, which becomes operative after the operation of said first feed control means, for rotating said transport belt in the reverse direction to feed the first document back to said pair of pinch rollers and registering the first document by pressing the trailing edge against the nipping portion of said pair of pinch rollers which was stopped rotating;

second register control means, which becomes operative after the operation of said first register control means, for driving said take-out means to take the second document out of said document support tray and to feed it to said pair of pinch rollers and registering the second document by pressing the leading edge against the nipping portion of said pair of pinch rollers which remains stationary; and second feed control means, which becomes operative after the operation of said first register control means and said second register control means, for driving said pair of pinch rollers and said transport belt to rotate in the document feed direction whereby the first and second documents are placed on the exposure platen side by side.

5. In an automatic document feeder for a copying apparatus including a document support tray on which a plurality of documents are loaded; take-out means for taking and feeding the documents out of said document tray one by one; a pair of pinch rollers which forms a nipping portion therebetween arranged downstreams of said take-out means, said pair of pinch rollers being selectively rotated in the document feed direction or kept from rotating; a transport belt arranged downstream of said pair of pinch rollers; said transport belt being selectively rotated in the document feed direction, rotated in the reverse direction or kept from rotating, a method of placing two documents on an exposure platen side by side, comprising the steps of:

loading a plurality of documents on said document support tray, said documents including at least a first and a second document;

taking the first document out of said document support tray by said take-out means;

feeding the first document toward the exposure platen by said pair of pinch rollers and transport belt;

stopping the rotation of said transport belt and said pair of pinch rollers when the trailing edge of the first document passes through said pair of pinch rollers;

rotating said transport belt in the reverse direction;

registering the first document by pressing the trailing edge against the nipping portion of said pair of pinch rollers which remains stationary;

taking and feeding the second document out of said document support tray toward said pair of pinch rollers by said take-out means;

registering the second document by pressing the leading edge against the nipping portion of said pair of pinch rollers which still remains stationary; and feeding the first and second documents to the exposure platen sequentially by the rotation of said pair of pinch rollers and said transport belt, whereby the first and second documents are placed on the exposure platen side by side.

* * * * *